US009993717B2

(12) United States Patent
Gasparro

(10) Patent No.: US 9,993,717 B2
(45) Date of Patent: Jun. 12, 2018

(54) SKIN CLEAT

(71) Applicant: Natural H2O Inc., Eastchester, NY (US)

(72) Inventor: Patrick Nicholas Gasparro, Eastchester, NY (US)

(73) Assignee: Natural H2O Inc., Eastchester, NY (US)

( * ) Notice: Subject to any disclaimer, the term of this patent is extended or adjusted under 35 U.S.C. 154(b) by 0 days. days.

(21) Appl. No.: 15/601,377

(22) Filed: May 22, 2017

(65) Prior Publication Data

US 2017/0252636 A1 Sep. 7, 2017

Related U.S. Application Data

(63) Continuation-in-part of application No. 14/745,536, filed on Jun. 22, 2015, now Pat. No. 9,656,151.

(51) Int. Cl.
*A63C 7/02* (2006.01)
*A63C 7/04* (2006.01)

(52) U.S. Cl.
CPC . *A63C 7/02* (2013.01); *A63C 7/04* (2013.01)

(58) Field of Classification Search
CPC ..... A63C 7/02; A63C 7/04
See application file for complete search history.

(56) References Cited

U.S. PATENT DOCUMENTS 1,783,833 A * 12/1930 Elsner ..... A63C 7/02 280/604
1,989,377 A * 1/1935 Osborn ..... A63C 7/02 280/604
2,287,252 A * 6/1942 Kaufmann ..... A63C 7/02 280/604
3,819,239 A * 6/1974 Arcouette ..... B62D 55/07 305/159
4,059,315 A * 11/1977 Jolliffe ..... B62D 55/27 305/165
4,095,813 A * 6/1978 Hall ..... A63C 7/02 280/604
4,219,214 A * 8/1980 Kostov ..... A63C 7/005 280/605
4,648,849 A * 3/1987 Monreal ..... A63C 11/00 280/611
4,674,764 A * 6/1987 Miesen ..... A63C 7/005 280/604
5,052,708 A * 10/1991 Matthews ..... A63C 7/00 280/604

(Continued)

*Primary Examiner* — Erez Gurari
(74) *Attorney, Agent, or Firm* — Leason Ellis LLP

(57) ABSTRACT

The present invention is a skin cleat device for increasing grip while ski touring. The skin cleat is configured to be attached around a ski by a skier without disengaging the ski boot from the skis and can be removed and re-attached depending on the needs of the user. The skin cleat is a strap-like device that includes two end sections and a studded central section there-between. The central section is intended to be placed underneath the base of the ski and skin such that the studs extend into the snow. The two end sections can be attached together by a coupling to form a continuous structure around the waist of the ski. Using the coupling, the structure can be tightened around the ski securing it in place and preventing the skin cleat from rotating around the ski or the studs from moving substantially when in use.

20 Claims, 21 Drawing Sheets

(56) References Cited

U.S. PATENT DOCUMENTS

| | | | | | |
|---|---|---|---|---|---|
| 5,188,441 | A * | 2/1993 | Rubel | B62D 55/26 | 305/165 |
| 5,401,088 | A * | 3/1995 | Rubel | B62D 55/26 | 305/187 |
| 5,641,214 | A * | 6/1997 | Kafka | B62D 55/286 | 305/180 |
| 5,676,437 | A * | 10/1997 | Holmgren | B62D 55/27 | 305/165 |
| 6,105,990 | A * | 8/2000 | Sutherland | A63C 7/04 | 280/604 |
| 6,203,126 | B1 * | 3/2001 | Harguth | B62D 55/286 | 305/162 |
| 6,604,755 | B2 * | 8/2003 | Ayliffe | A63C 11/00 | 280/604 |
| 6,684,534 | B2 * | 2/2004 | Dodge | A43C 15/061 | 280/14.21 |
| 7,226,085 | B2 * | 6/2007 | Baker | A63C 17/002 | 280/608 |
| 7,287,775 | B2 * | 10/2007 | Walker | A63C 7/04 | 280/400 |
| 7,374,207 | B2 * | 5/2008 | McCoy | A63C 5/062 | 280/809 |
| 9,010,797 | B2 * | 4/2015 | Elliott | A63C 7/04 | 280/604 |
| 9,067,124 | B2 * | 6/2015 | Elliott | A63C 7/04 | |
| 2002/0101059 | A1 * | 8/2002 | Ayliffe | A63C 7/02 | 280/604 |
| 2002/0101071 | A1 * | 8/2002 | Ayliffe | A63C 11/00 | 280/809 |
| 2003/0075901 | A1 * | 4/2003 | Long | A63C 11/00 | 280/604 |
| 2008/0174089 | A1 * | 7/2008 | Ekberg | A63C 5/02 | 280/603 |
| 2017/0252636 | A1 * | 9/2017 | Gasparro | A63C 7/04 | |

* cited by examiner 450
456
133
130
108
133
133
130
133
108
133
130
150
108

SKIN CLEAT

CROSS-REFERENCE TO RELATED APPLICATIONS

This non-provisional application is a continuation-in-part of U.S. Pat. No. 9,656,151 titled "SKIN CLEAT" issuing on May 23, 2017 (application Ser. No. 14/745,536, filed Jun. 22, 2015), which is hereby incorporated by reference as if set forth in its entirety herein.

TECHNICAL FIELD OF THE INVENTION

This patent application relates generally to the field of ski touring devices and, in particular, devices configured to be used with skis and to improve the purchase of the ski on a slope while ascending.

BACKGROUND OF THE INVENTION

Ski touring is a form of skiing where both uphill and downhill travel are possible while wearing the skis. Typically touring is done off-piste and outside of ski resorts. Typically, the bindings and/or boots are configured to allow for free movement of the heel of the skier to enable a walking pace and walking movement, as in Nordic skiing or telemark skiing.

Going uphill or across a slop while ski touring also requires grip so that a ski can glide forward but not slide backwards when weighted. In order to travel uphill on skis (or specialized split-board snowboards), the skier can apply "skins" to the bottom surface of the ski. A skin is configured to adhere to the bottom of the ski and be attached to the tip and tail of the ski and is sized to have approximately the same length and width as the ski. The skin includes a bottom layer of short nylon or mohair fibers that extend from the base of the skin in the direction of the tail end of the skin to provide directional friction that allows the ski to glide forward but not slip backwards.

Skins can effectively prevent skis from slipping backwards on slopes of a moderate angle. This maximum incline that can be climbed using skins depends on snow conditions (i.e., decreases on an icy slope or in hard-pack and slick snow conditions where the skier weight dispersed throughout a ski does not break through the snow crust and can leave the skier sliding backwards), however, in general, skins can be effective up to around a thirty to thirty-five degree incline. If the incline is too steep for the skins to be effective, the skier can switchback (i.e., traverse back and forth across the slope), which increases the length of the climb, or remove the skis to hike the slope, which can be less efficient. In addition or alternatively, the skier can also attach ski crampons that increase the skier's purchase (i.e., grip) on the slope.

A ski crampon is a generally U-shaped device that attaches to the underside of the ski boot or the binding. An exemplary ski crampon is depicted in FIG. 1. As shown, the ski crampon is a rigid structure that includes two metal blades, each of which is approximately a few inches wide and a few inches tall, that are connected by a bridge. The bridge is configured to attach the crampon to the skier's boot or ski binding. The blades straddle the two sides of the ski, one on each side, and extend down into the slope so as to cut deeper into the snow than the skin.

Ski crampons are attendant with a number of drawbacks. A main drawback to using ski crampons is that they can only be attached for use when the ski-boot is disengaged from the binding. This can be a precarious endeavor when on a steep slope as it can be difficult for a skier to safely disengage the boot from the binding to remove the ski, attach the crampon to the boot or the binding and then re-attach the ski without inadvertently losing balance or allowing the ski to fall down the slope. The process is also time consuming and is ultimately inconvenient even on a low angle slope, particularly in deep snow, which a skier can easily sink into when his/her weight is not supported by the entire surface of the skis.

Another drawback of ski crampons stems from the fact that the blades straddle the sidewalls of the ski and are attached to the boot or the binding. This causes the majority of the forces applied to the crampon to be transferred to the attachment points (e.g., the boot or binding attachment) rather than the underside of the ski, this is particularly evident when on icy terrain and the majority of the skiers weight is on the crampon rather than distributed across the entire base of the ski. The configuration of ski crampon blades, which are positioned to the side of the skis and extend linearly along the side of the skis, localizes the additional grip a) to the two sides of the ski as opposed to the underside of the ski, and b) in a lengthwise manner (small cross/section when viewed from the front). Moreover, ski crampons are also limited in that they have a dedicated attachment point (e.g., underside of boot or ski binding attachment) and are not moveable to an alternative location. Accordingly, it is not easy or convenient to use multiple crampons on a single ski, which limits a skier's ability to further increase purchase depending on conditions. Even if a ski crampon could be fixed at multiple locations, it would nonetheless be inconvenient and time consuming to relocate crampons to an alternative location and, as such, would not easily be performed while touring. Ski crampons also require complex attachment mechanisms and sizeable metal blades that can be heavy, are difficult to store compactly in a skier's pack. Also they can be costly accessories. In addition, due to the fixed width of crampons, ski crampons do not accommodate skis having a larger width than the crampon and therefore requires skiers with skis of varying widths to purchase multiple crampons. Other disadvantages to a traditional ski crampon includes binding specific construction as binding manufactures often make ski crampons binding specific, so a skier with multiple skis has to buy multiple crampons. Moreover, because the teeth of ski crampons are not replaceable, the ski crampons have limited usability after the metal spikes of a ski crampon are worn or damaged, for instance, from striking a rock and bending the teeth of the ski crampon.

As such, it is desirable to provide a skin cleat device that can be used to improve purchase while ski touring, can be easily attached to the ski (or ski and skin) without requiring a skier to disengage his/her boot from the ski bindings, can distribute the forces received by the device directly to the underside of the ski, can be configured to have replaceable studs, can have studs that are selectively positionable, and can provide a cross-wise area of friction and addresses the foregoing deficiencies of ski crampons. It is with respect to these and other considerations that the disclosure made herein is presented.

SUMMARY OF THE INVENTION

According to a first aspect, a skin cleat is provided for use with a ski, ski-boot and binding assembly and to improve purchase while ascending a slope. The skin cleat includes an elongate strap having first and second end sections and having a central section there-between. The central section has a first thickness and a bottom side and a top side. The skin cleat also includes a coupling for selectively attaching the first and second end sections. Attachment of the first and second end sections results in the formation of a continuous structure. The skin cleat also includes a backing having a thickness, a first side abutting the top side of the central section and an opposite second side for placement against an underside of the ski and for protecting the underside of the ski. The skin cleat also includes a stud having a proximal end and a distal end and a head disposed at the proximal end. The stud is mounted to the backing and extends away from the bottom side of the central section. In addition, the backing further comprises a first and a second opening for receiving the strap therethrough such that the strap passes along a length of the backing and the backing is positionable along the central section of the strap.

According to a further aspect introduced in this application, the backing further comprises a third and a fourth opening for receiving the strap therethrough. The first, second, third and fourth openings extend through the first and second sides of the backing and are provided for receiving the strap therethrough such that the strap passes along a length of the backing and the backing is positionable along the central section of the strap within and through the first, second, third and fourth openings. According to a still further aspect, the first, second, third and fourth openings in the backing are arranged such that friction between the backing and the central section of strap passed through the openings maintains the backing in position along the strap when the skin cleat is tightened about the waist of the ski while still allowing the backing to be positionable along the central section of the strap.

According to a further aspect of the present invention, there is provided a skin cleat for use with a ski, ski-boot and binding assembly and to improve purchase while ascending a slope. The skin cleat includes an elongate strap having first and second end sections and having a central section there-between. The skin cleat also includes a coupling configured to attach the first and second end sections and thereby resulting in the formation of a continuous structure. The skin cleat further comprises a backing having a first surface and an opposite second surface for protecting the underside of the ski. In particular, the backing comprises a first and a second opening for receiving the strap therethrough such that the strap passes along a length of the backing and the backing is positionable along the central section of the strap. In addition, the skin cleat further includes one or more studs that have a proximal end and a distal end and a body extending therebetween, The one or more studs are mounted to the backing and depend downwardly away from the first side of the backing in a direction away from the backing and the strap.

According to a further aspect, a skin cleat is provided for use with a ski, ski-boot and binding assembly and to improve purchase while ascending a slope. The skin cleat includes an elongate strap having first and second end sections and having a central section there-between. The skin cleat also includes a coupling configured to attach the first and second end sections and thereby resulting in the formation of a continuous structure. The skin cleat further comprises a backing having a first surface and an opposite second surface. In addition, the backing comprises a first and a second opening through the first and opposite second surface for receiving the strap therethrough such that the strap passes along a length of the backing and the backing is positionable along the central section of the strap. In addition, the skin cleat further includes one or more studs that have a proximal end and a distal end and a body extending therebetween, The one or more studs are mounted to the backing and depend downwardly away from the first side of the backing.

These and other aspects, features, and advantages can be appreciated from the accompanying description of certain embodiments of the invention and the accompanying drawing figures and claims.

DETAILED DESCRIPTION OF CERTAIN EMBODIMENTS OF THE INVENTION

By way of overview and introduction what is disclosed is a skin cleat device that is configured to increase grip while ski touring. The skin cleat is configured to be attached around a ski by a skier without disengaging the ski boot from the skis and can be removed and re-attached depending on the needs of the user. The skin cleat is a strap-like device that includes two end sections and a studded central section therebetween. The central section is intended to be placed underneath the base (i.e., underside) of the ski (and skin, if a skin is being used) such that the studs extend down into the snow. Two end sections can be attached together by a coupling to form a continuous structure around the waist of the ski (e.g., orthogonal to the direction of ski travel). Using the coupling, the structure can be tightened around the ski to secure it in place and to prevent the structure from rotating around the ski or otherwise moving or deflecting when in use. Although the skin cleat is described herein in reference to use with a ski having alpine or telemark bindings, the exemplary skin cleat can be similarly used with "split-board" snowboard touring boards and associated bindings. In use, the studs, which protrude from the central section towards the ground engage the slope. In particular, in icy or crusty/hard-pack snow condition, the weight of the skier concentrated on the studs causes the studs to break through the icy or crusty surface of the slope and engage the slope, whereas weight dispersed throughout a ski without such studs would not, leaving the skier slipping.

According to a salient aspect, the skin cleat is configured to allow a skier to temporarily secure the skin cleat around a ski without disengaging the boot from the ski binding. Furthermore, because the skin cleat does not require coupling of the skin cleat to the boot or the binding, the skin cleat can be secured around the ski at a variety of possible locations and multiple skin cleats can be used on a single ski to further improve grip.

The referenced systems and methods are now described more fully with reference to the accompanying drawings, in which one or more illustrated embodiments and/or arrangements of the systems and methods are shown. The systems and methods are not limited in any way to the illustrated embodiments and/or arrangements as the illustrated embodiments and/or arrangements described below are merely exemplary of the systems and methods, which can be embodied in various forms, as appreciated by one skilled in the art. Therefore, it is to be understood that any structural and functional details disclosed herein are not to be interpreted as limiting the systems and methods, but rather are provided as a representative embodiment and/or arrangement for teaching one skilled in the art one or more ways to implement the systems and methods.

Figure 1:
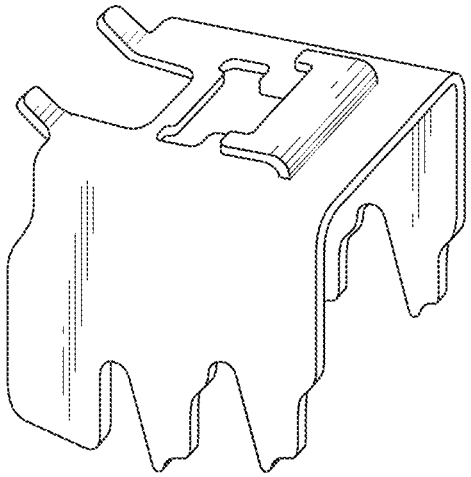
PRIOR ART Fig. 1
FIG. 1 is a simplified diagram illustrating an exemplary ski crampon device.
Figure 2A:
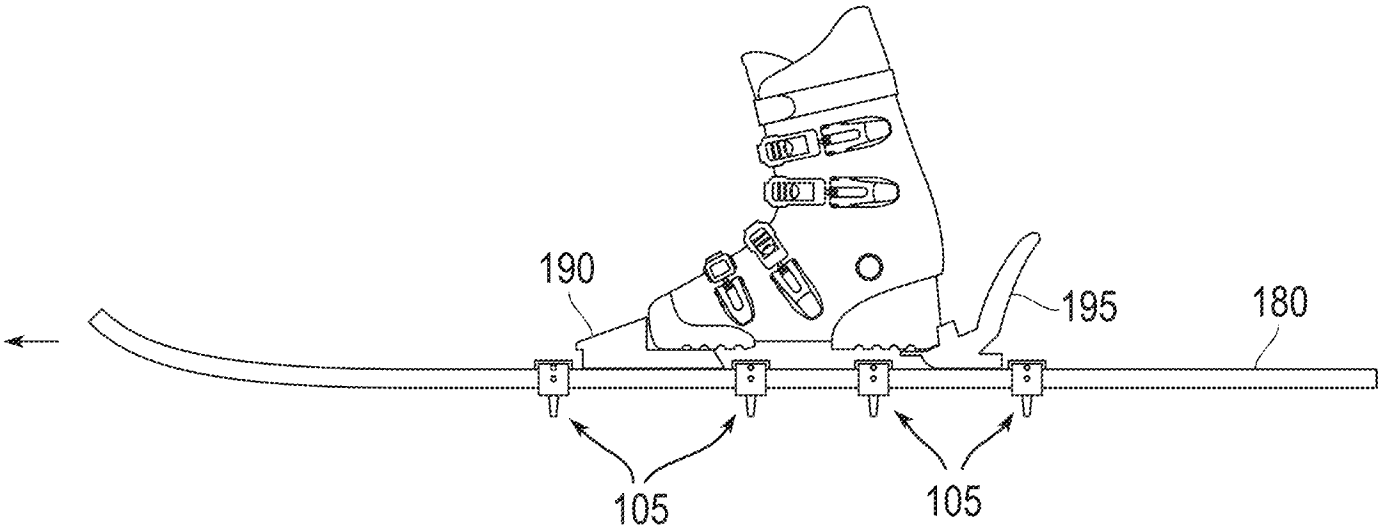
FIG. 2A is a simplified diagram illustrating an exemplary placement of skin cleats around a ski according to an embodiment of the present invention.
Figure 2B:
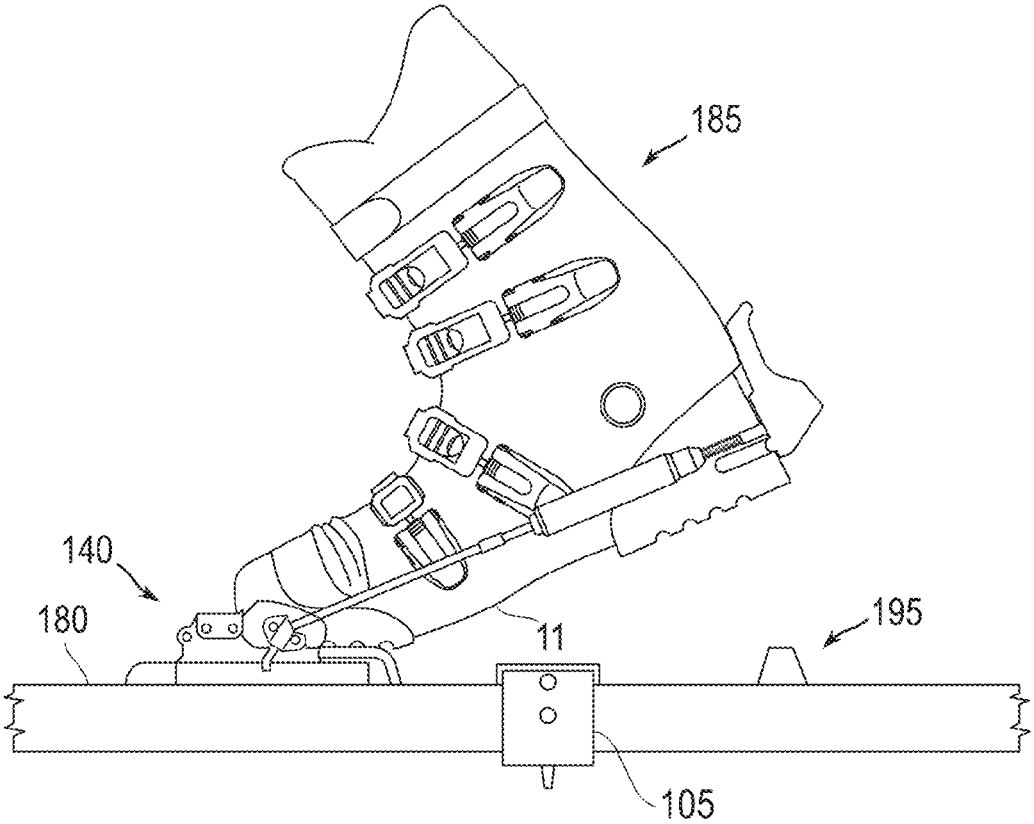
FIG. 2B is a simplified diagram illustrating an exemplary placement of a skin cleat around a ski according to an embodiment of the present invention.

FIG. 2A depicts multiple skin cleats 105 engaged in an intended fashion around a typical ski that is set-up for ski touring. As shown, the typical set-up includes the ski 180, boot 185 and bindings, i.e., toe binding 190 and heel binding 195 mounted to the top of the ski in the general vicinity of the middle of the ski (referred to herein as the waist). As shown, one or more of the skin cleats 105 can be secured around the waist at a variety of possible locations including, for example, in-front of or behind the toe binding 190 and/or heel binding 195. Alternative placements of the skin cleat are possible depending on the particular type of binding system used (e.g., telemark, alpine touring and the like). In addition, the skin cleat is not required to be placed adjacent to a binding structure. For instance FIG. 2B depicts a ski-touring set up that includes an alternative binding configuration, namely, a telemark binding, with the skin cleat 105 positioned underneath the boot between the toe and/or heel portions of the binding.

Figure 3A:
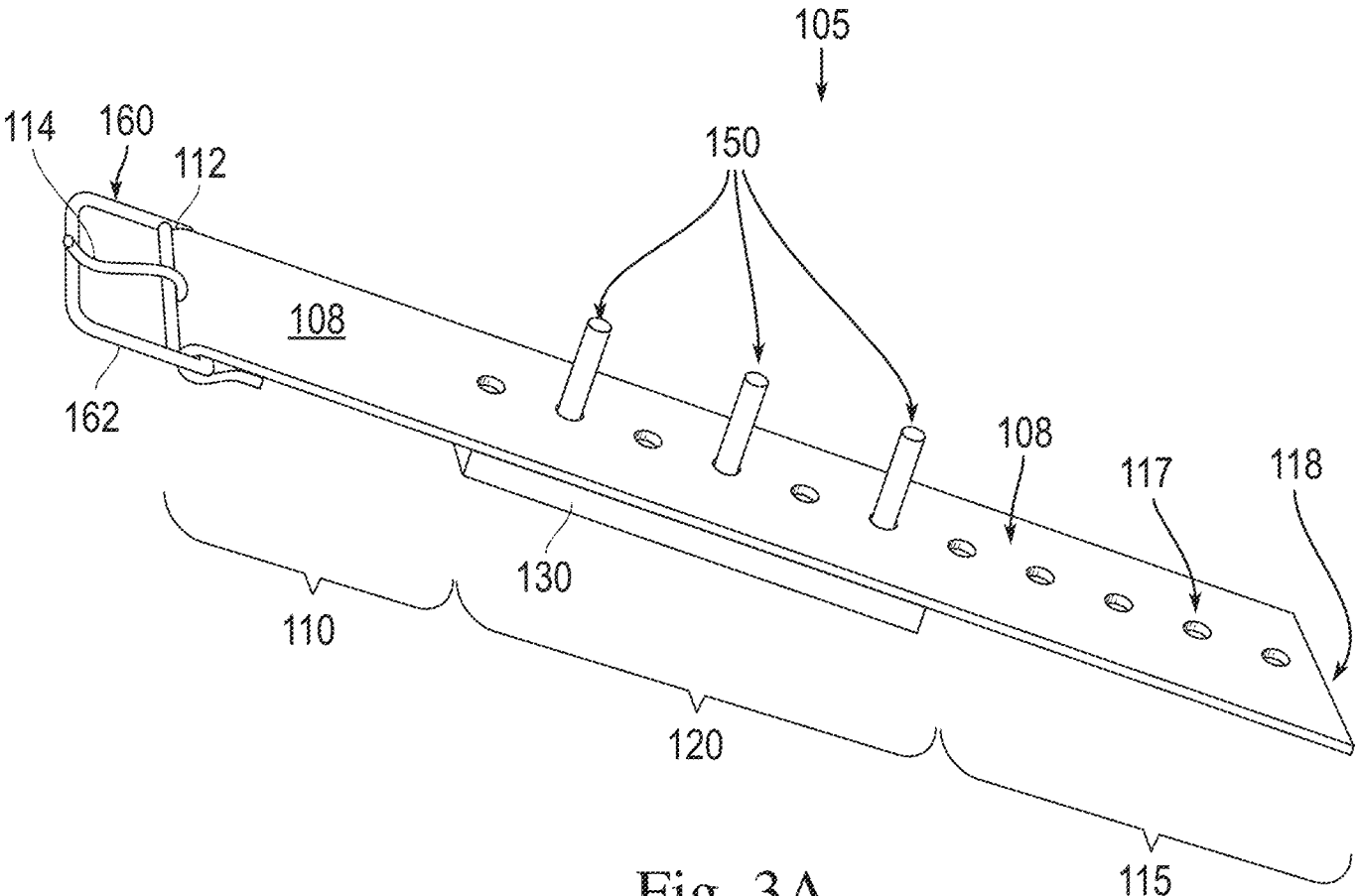
FIG. 3A is a diagram illustrating an exemplary configuration of a skin cleat according to an embodiment of the present invention.

An exemplary arrangement of the skin cleat 105 will be further described in reference to FIGS. 3A-3D. FIG. 3A depicts a perspective view of the skin cleat 105 in an unattached configuration. As shown, the skin cleat includes an elongate strap having first end section 110 and a second end section 115 and a central section 120 there between. Also shown is a coupling 160 for selectively attaching the first and second end sections resulting in the formation of a continuous structure. The skin cleat also includes a backing 130 for protecting the underside of the ski when in use. Also shown are studs 150 extending through at least a portion of the first thickness of the central section and extending away from the bottom side of the central section.

Any number of conventional coupling means can be used to attach the first and second sections to one another including but not limited to mechanical fasteners, latches, levers, buckles, clasps and the like. For example, as shown in FIG. 3A, the coupling can be in the form of a buckle or clasp structure 162 attached to the end 112 of the first section 110 and a plurality of openings 117 that are formed in the second section 115. The buckle can be configured to receive the end 118 of the second section therethrough and can include a prong 114 that is received within one of the plurality of openings 117 and matingly engaged. As would be understood, the holes 117 can be spaced such that the first and second end sections can be attached to form the continuous structure of adjustable diameter and thereby accommodate a variety of ski widths (and widths of split-board snowboards and other such alpine touring systems).

Figure 3B:
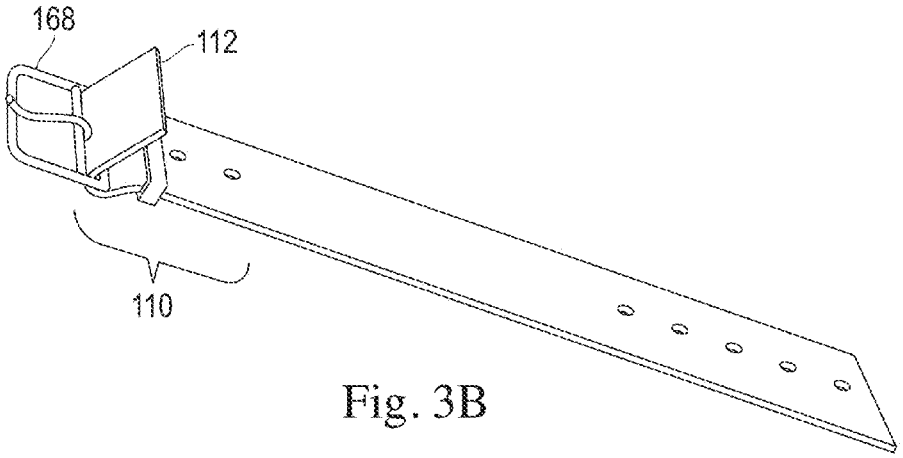
FIG. 3B is a diagram illustrating a further configuration of a skin cleat according to an embodiment of the present invention.

In some implementations, the buckle 162 is not permanently attached to the end 112 of the first section 110 and can be selectively positioned at a plurality of locations along the length of the first section. For instance, FIG. 3B, depicts the buckle 162 positioned at an alternative location along the length of the first section 110. Accordingly, the location of the buckle can be adjusted to suit the needs of the skier and to accommodate the equipment used. For instance, turning briefly to FIG. 3C, which depicts a front view of the skin cleat 105 tightened around the ski 180, skin 182 (the front section of which are depicted as cut-away) and base plate of a toe binding 192, a particular binding set-up and ski width might require that the buckle portion of the coupling is situated proximate to a side 187 of the ski such that the skin cleat can be more easily secured around the ski, adjusted (e.g., tightened and loosened) and or removed by the user. Accordingly, an adjustable coupling provides the skier the ability to fine-tune the placement of the coupling to best suit the ski and binding and allow for ease of access and adjustment when in use. Moreover, the ski strap wraps around the skin it also offers a complementary utility of adding support to a non-sticking skin losing adhesiveness to the ski.

Returning to FIG. 3A, although the exemplary embodiment shows the coupling 160 as a buckle attached to the first section 110 and is configured to engage complementary holes 117 formed in the second section 115, it can be appreciated that alternative coupling arrangements can be used. For instance, the coupling can be comprised of fasteners such as matched pieces of hook and loop closures (e.g., corresponding male and female velcro segments on first and/or second end sections), snaps, buttons and the like. By way of further example, the coupling can include two complementary snap-lock buckles disposed on a respective end sections. The snap-lock buckles can be configured to matingly engage and to permit the skin cleat to be tightened and loosed by adjusting the overall length of the strap. By way of further example, the coupling can be a spring loaded cam buckle designed to receive the second end 118 therein and securely engage the second section 115. Similarly the coupling can include ratcheting buckles, cinching devices (e.g., loops and fasteners), draw-latches, lever buckles, tensioners and the like.

Preferably, the strap 108 is composed of any number of conventional materials that are suitable for use in straps including but not limited to plastic, rubber, leather, synthetic materials (moldable/polymerizable materials), webbing and the like. In the exemplary embodiment, the strap is defined by a continuous segments of material. In alternative arrangements the strap can be comprised of a plurality of segments of one or more materials.

The strap 108 is preferably a robust material that has a tensile strength suitable to withstand the tensile force that a user would put on the strap when securing the strap around the ski and tightening the strap such that the skin cleat is firmly secured around the ski and is suitable to withstand the forces exerted on the strap when in use. Moreover, strap is preferably configured to withstand the torsional forces applied to the strap when in use. For instance, as the studs 150 engage the surface of the slope and gravity pulls the ski down the slope, a force is exerted on the studs in the direction of the tail of the ski. Accordingly, the strap has a width and torsional rigidity that is suitable to withstand torsional forces when the skin cleat is secured around the waist of the ski.

Figure 3C:
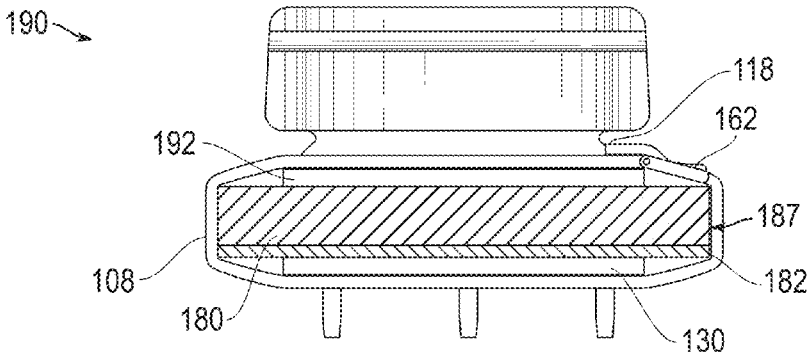
FIG. 3C is a diagram illustrating an exemplary configuration of a skin cleat disposed around a ski and skin according to an embodiment of the present invention.

Preferably the strap is flexible such that, it conforms to the contours of the ski and/or binding when secured in place for use, for instance, as shown in FIG. 3C, which depicts a front cross-sectional view of the skin cleat 105 tightened around the ski 180, skin 182 and a base-plate 192 of the toe binding 190 and showing the strap 108 conforming to the profile of the ski, skin and baseplate.

In some arrangements, the first and second end sections have a thickness that is sufficiently small to fit between the boot or binding and the ski or is otherwise compressible such that, if a portion of the strap is positioned between the ski and the boot or binding, the strap does not interfere with the operation of the ski boot and/or binding assembly. FIG. 2A depicts the boot and binding with the heel of the boot touching the rear binding, which is typical when a ski is weighted and stationary. FIG. 2B depicts the boot coupled to the toe binding and having an elevated and free moving heel, which is typical while the skier is advancing the ski while walking.

Figure 3D:
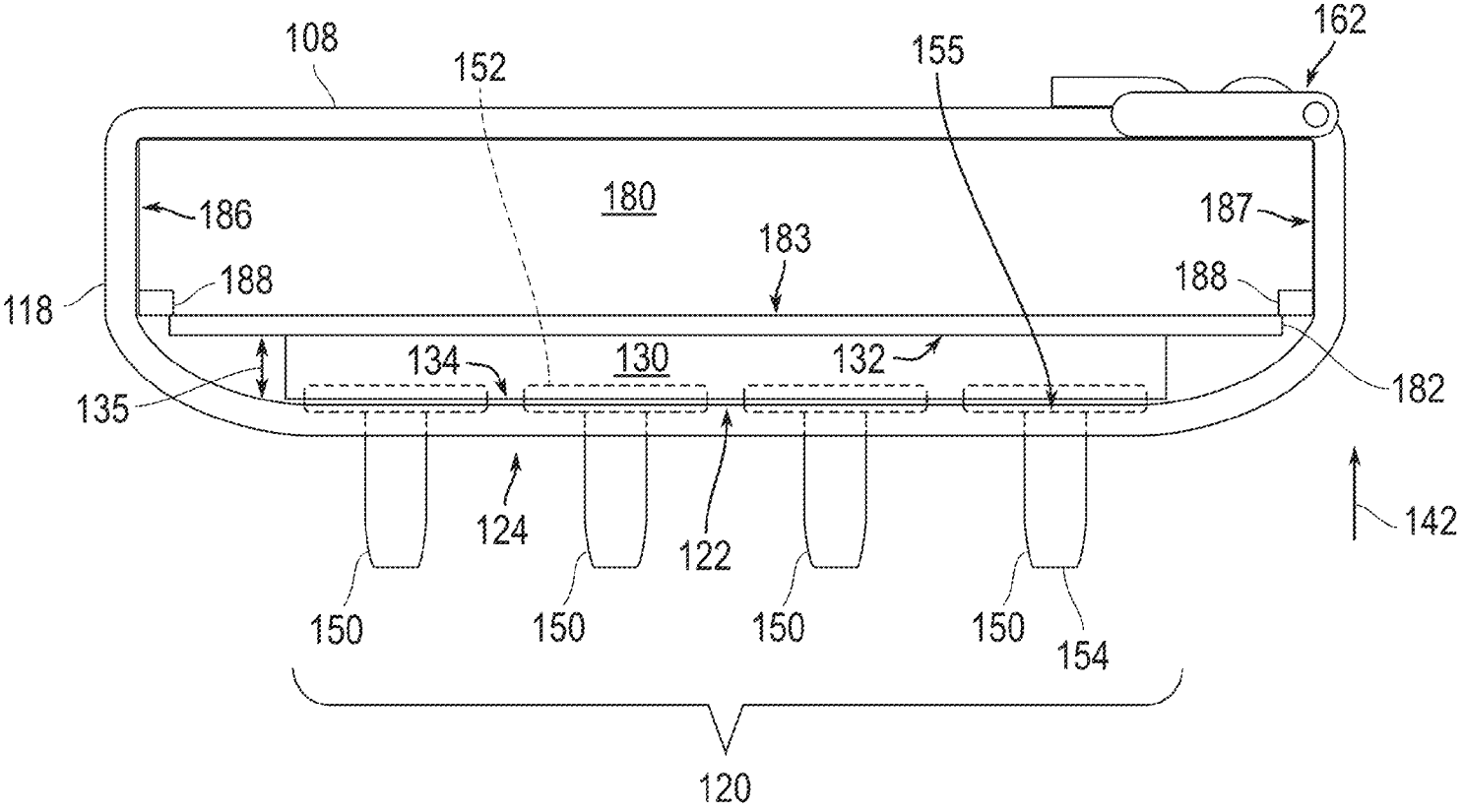
FIG. 3D is a diagram illustrating an exemplary configuration of a skin cleat according to an embodiment of the present invention.

FIG. 3D depicts a more detailed front view of the skin cleat of the present embodiment disposed around the waist of the ski 180 and skin 182 (the front section of which have been cut-away to more clearly show the skin cleat). As shown, the ski includes has an underside 183 (e.g., base) first and second sidewalls 186 and 187, respectively, and respective edges 188. The central section 120 of the strap has a bottom side 124 and a top side 122 defining a first thickness 123 there-between. The backing 130 has a first side 134, which abuts the top side 122 of the central section 120 of the strap, and has an opposite second side 132 for placement against the underside of the skin 182 (or against an underside of the ski 183 if a skin is not being used). Also shown are studs 150, which each having a proximal end 152 and a distal end 154 and a head 155 disposed at the proximal end. The portion of the skin cleat that includes the central section of the strap, the backing and the studs are collectively referred to as the central portion of the skin cleat.

Figure 3E:
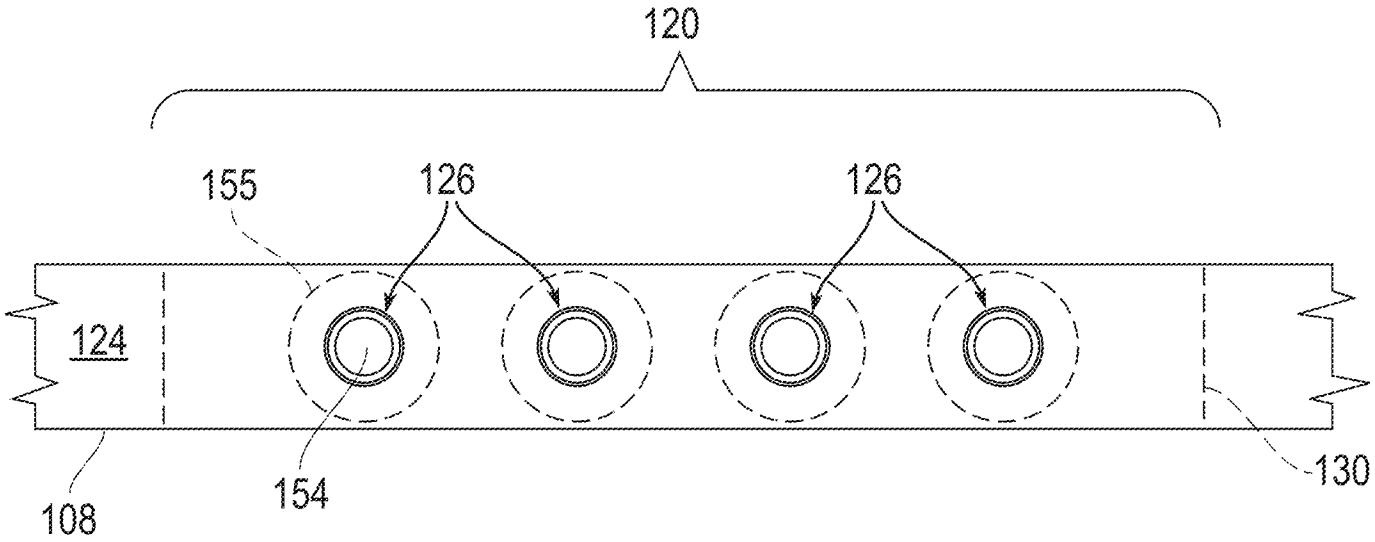
FIG. 3E is a diagram illustrating an exemplary configuration of a skin cleat according to an embodiment of the present invention.

In the particular arrangement shown in FIG. 3D, the first side 134 of the backing abuts the proximal end 152 of the studs and the top side 122 of the central section 120 of the strap 108 such that the heads of the studs are disposed between the backing and the central section of the strap. FIG. 3E depicts a bottom plan view of the central section 120 of the strap 108 and showing the bottom side 124, the distal end 154 of the studs and the head 155 disposed between the strap 108 and the backing. Also shown are the holes 126 formed in the central section of the strap that the studs can protrude through. Although the backing and the central section of the strap are shown as elongate rectangular portions having generally the same width, it can be appreciated that alternative shapes and widths are possible. For example, the width of the backing and/or the strap can be wider in the central region 120.

Returning to FIG. 3D, in use, the studs 150 (which are positioned below the underside of the ski) engage the slope and forces in the vertical direction 142 (e.g., forces opposing the weight place on the studs by the skier) are transferred through the body of the studs to the proximal end 154. As previously noted, the backing protects the underside of the ski. More specifically, the backing has a thickness 135 and is composed of one or more materials that absorb and/or distribute the forces transferred to the backing by the studs. For instance, the backing can be comprised of a compressible polymer material so as to cushion the skin 182 and the underside of the ski 182, which are generally composed of softer and more delicate materials (e.g., wax, polymer and the like) and are susceptible to scratching and damage. The backing can also have a rigidity that is sufficient to distribute the forces from the studs across the second side 132 of the backing. In some implementations, the backing can be composed of multiple materials having different material properties, for instance, backing can include a rigid layer of material, and the second side of the backing can be composed of a compressible material.

As shown in FIG. 3E, which is a bottom view of the central section 120, the studs protrude through the holes 126 formed in the central section 120 of the strap 108 and the head 155 of the studs, which are wider than the body of the stud, is disposed between the first side of the backing 134 and the top side of the strap 122 (i.e., in a layered or "sandwiched" fashion). Accordingly, when in use, the studs are held in place due to interference from the head 155 of the studs being positioned between the backing and the strap and by the body of the studs protruding through the holes in the strap. Although the studs are depicted as having a generally cylindrical body, it can be appreciated that the studs can have a variety of shapes that are suitable for engaging a slope, for example and without limitation, the studs can be pyramidal or blade shaped. According to a salient aspect, various embodiments described herein include studs that can be attached and detached from the skin cleat assembly. As a result, the skin cleat allows for a variety of possible stud placements and configurations including use of studs of different shapes and sizes. Accordingly, after a stud is worn or damaged, for instance, from striking a rock and bending, the stud can easily be exchanged.

The holes formed in the strap can have a size that is smaller than or equal to the size of the body of the stud and can be formed using an elastic material. Accordingly, the holes can deform when the stud is inserted therethrough (and recover its shape after deformation) such that the holes tightly engage the body of the studs, hold the studs in position and prevents side-to-side movement of the studs when in use. The engagement of the studs by the backing and the strap also helps to prevent the studs from deflecting when lateral forces are applied, particularly when the skin cleat assembly is tightly secured around the ski and the backing, studs and strap are firmly held in place. However, when the skin cleat is not secured around the ski, the flexibility in the strap and the backing allows the skin cleat to be more easily folded for storage.

The backing, studs and central section of the strap can be held together such that they are generally immovable relative to one another and thereby imparting rigidity to the studded central portion of the skin cleat. For example and without limitation, the layers of material that define the backing, the strap and the rigid head of the studs therebetween can be held together by tightening the assembly against the rigid underside of the ski.

Figure 4A:
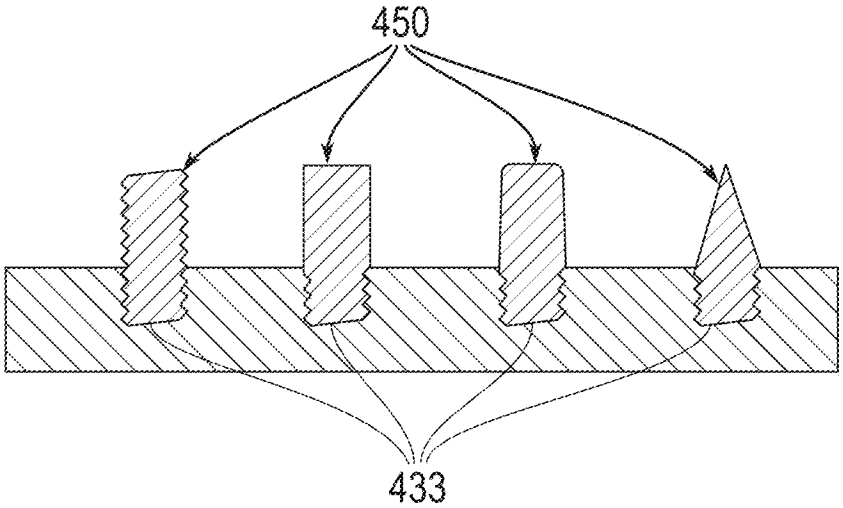
FIG. 4A is a diagram illustrating an exemplary configuration of a skin cleat according to an embodiment of the present invention.

In some arrangements, the stud can be joined to the backing or the strap, or a combination of the foregoing. FIG. 4A, depicts a cross-sectional view of an exemplary configuration in which a variety of different shaped studs 450 are removably engaged to a backing 430. As shown, the backing 430 includes a mount 433, which in this exemplary arrangement is a threaded cylindrical hole within the backing. The head of the stud can have a complementary shape and engagement mechanism (e.g., threads) such that the head of the stud can matingly engage the threaded mount. It can be appreciated that other complementary mount and head locking systems can be used to attach the stud to the mount in either a permanent or temporary fashion. In addition or alternatively, the studs can be integrally formed to one or more portions of the backing using any conventional manufacturing techniques.

Figures 4B, 4C, 4D, 4E:
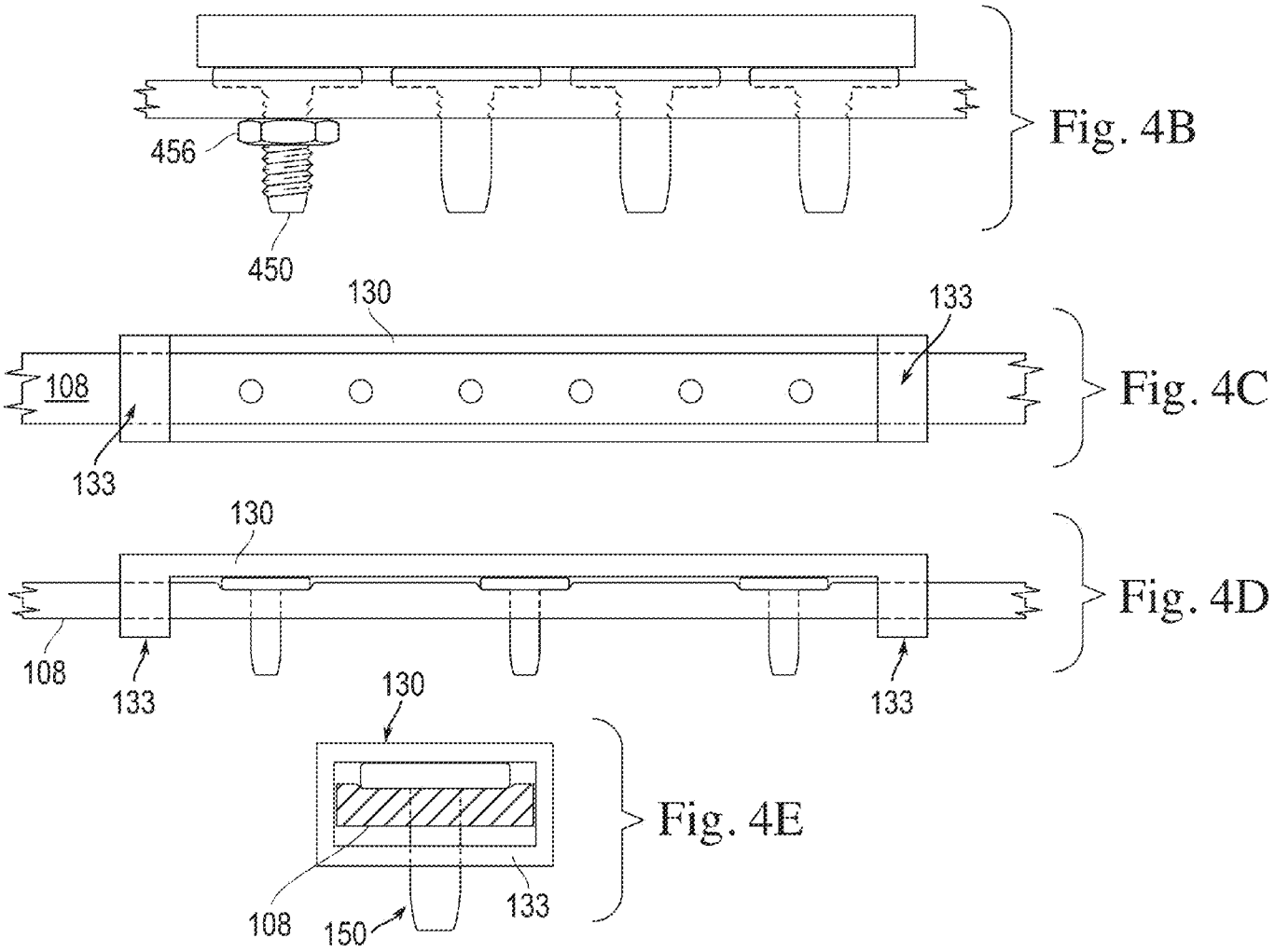
FIG. 4B is a diagram illustrating an exemplary configuration of a skin cleat according to an embodiment of the present invention.
FIG. 4C is a diagram illustrating an exemplary configuration of a skin cleat according to an embodiment of the present invention.
FIG. 4D is a diagram illustrating an exemplary configuration of a skin cleat according to an embodiment of the present invention.
FIG. 4E is a diagram illustrating an exemplary configuration of a skin cleat according to an embodiment of the present invention.

It can also be appreciated that, in addition or alternatively, the stud can be attached to the strap, for instance, by incorporating a mount into the strap that is configured to matingly engage the stud. In addition or alternatively, one or more mechanical locking mechanisms can be used to fasten the stud to the strap. For instance, as shown in FIG. 4B, which is a front view of a central section of the skin cleat and showing a backing, strap and studs, the body of the stud 450 can be threaded and a threaded nut 456 can be screwed onto the body of the stud and tightened so as to securely hold the strap between the head and the nut. It can also be appreciated that, in a configuration where the stud is mounted to the backing, similar locking mechanisms can be used to join the backing, stud and the strap together.

The backing can be joined to the strap, either in a fixed or movable configuration. For example, the backing can be joined to the strap by glue or other adhesive, rivets, screws, fasteners, clips or other suitable temporary or permanent joining means. By way of further example, FIG. 4C-D depict a bottom plan view and front plan view, respectively, of the backing 134 coupled to the strap 108 using one or more mounts 133. As shown, the mounts 133 can be a hollow structure that is integrally formed to the backing such that the strap 108 can be passed therethrough and the backing can slide linearly along the length of the strap. FIG. 4C depicts the assembly with studs removed, and FIG. 4D depicts three studs selectively positioned for use such that the head of each stud is disposed between the backing and the strap and the body of each stud protrudes through a respective hole among the plurality of holes in the strap. FIG. 4E depicts an end-view of the arrangement shown in FIGS. 4C-D and also depicts a stud disposed between the strap 108 and the backing 130 and depicts the end of the strap as cut-away.

Figure 5A:
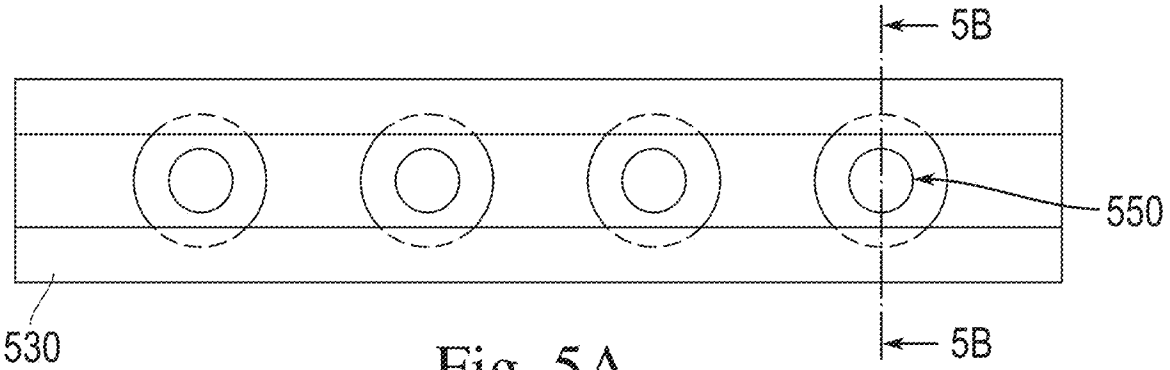
FIG. 5A is a diagram illustrating an exemplary configuration of a skin cleat according to an embodiment of the present invention.
Figure 5B:
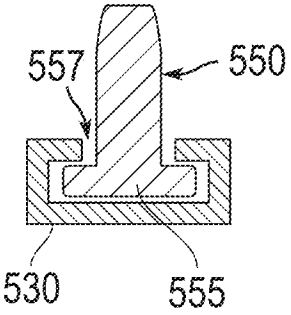
FIG. 5B is a diagram illustrating an exemplary configuration of a skin cleat according to an embodiment of the present invention.

FIG. 5A, depicts a bottom-plan view of another exemplary arrangement of the stud 550 and backing 530. FIG. 5B depicts a cut-away end-view of the backing of FIG. 5A which, as shown, can be formed to define an elongate c-shaped channel. The channel formed by the backing can be sized to receive a complementary shaped head 555 of the stud therein and the body of the stud can protrude through the opening 557 of the channel. The complementary shape of the head and channel serves to prevent the head from being pulled through the opening, allows the stud to slide linearly within the backing such that the studs can be selectively positioned and keeps the body of the stud generally perpendicular to the backing. Similar to the strap configuration shown in FIG. 4B, in the exemplary stud/backing arrangement shown in FIGS. 5A and 5B, the body of the studs can be inserted through corresponding holes in the strap which serves to holds the studs in place for use and prevents the studs from further movement along the length of the backing when in use.

When in use, the skin cleat preferably has a secure grip around the ski to keep from shifting from the weight of the skier, i.e., sliding along the length of the ski or rotating around the waist of the ski. As previously noted, in one exemplary implementation, the end sections are made of a polymer material so as to provide a strap and coupling that allows the skin cleat to be tightly secured around the waist of the ski such that the area of contact between the skin cleat and the ski (and/or binding assembly) is large enough to provide sufficient frictional force when in use. Also, the second side 132 of the backing is preferably a friction material that has a relatively high coefficient of friction to increase the frictional force between the backing and the underside of the ski (or skin) when in use, including but not limited to synthetic and natural polymer compounds such as rubbers and plastics. The friction material can be a single piece of material, such as a strip of rubber disposed along the length of the backing. Alternatively, the friction material can be one or more pieces of material that are attached to the first side 132 at specific locations along the length of the backing. As a further alternative, friction material can be a material that is applied to the first side 132 such as a spray on rubber compound. Because the skin cleat is likely to be used in combination with a climbing skin, the second side of the backing can also be configured to engage the directional fibers of the skin. For instance, the second side can comprise short nylon or mohair fibers (like a climbing skin) that extend from the second side in a direction that is perpendicular to the length of the elongate strap (i.e., in the direction of ski travel) such that the second side can be placed against skin and the fibers of the backing are oriented opposite to the direction of the fibers of the skin.

The assembled backing, studs and central section of the strap (collectively referred to as the "central portion") are preferably configured to resist rotating out of position when in use. This can be achieved by providing a central portion that has sufficient rigidity such that, when it is placed underneath the base of the ski and the assembly is tightened around the waist of the ski, the rigidity of the assembled studs, backing and strap resist rotation beyond the underside of the ski under typical use (e.g., steep side hill slopes that would exert forces in the cross-wise direction of the ski).

Figure 6:
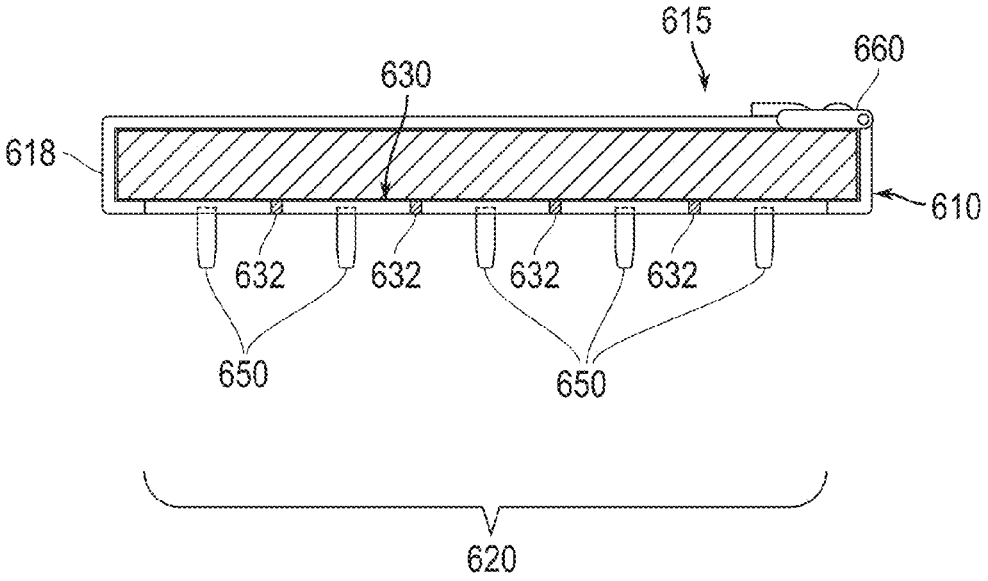
FIG. 6 is a diagram illustrating an exemplary configuration of a skin cleat according to an embodiment of the present invention.

If the backing is formed from a rigid material, the backing can be divided into multiple segments with flexible joints there-between. For instance, as shown in FIG. 6, which is a front view of an exemplary skin cleat assembly and showing the front end of the ski cut-away, the backing 630 can be formed of a rigid material that is divided into segments separated by flexible joints 632 and the studs can be mounted to one or more of the segments. As a result, when the skin cleat is tightened around the waist of the ski, the rigidity of the individual segments resists rotation of the central portion 620 beyond the edge of the underside of the ski. However, when the skin cleat is loosened at least a prescribed amount, the flexibility of the joints 632 allows the skin cleat to be rotated around the waist of the ski without fully de-coupling the end sections. For instance, the coupling can be a draw-latch (or other such tension latch, ratcheting buckle and the like) that can be transitioned between a tightened state and a loosened (yet still attached) state, thereby allowing the skier to rotate the studs from a first operative position (i.e., underneath the ski) to a second operative position (i.e., a position in which the studs do not engage the slope) and then transition the buckle to the tightened state again such that the skin cleat is held firmly in position around the ski. It can be appreciated that other buckle arrangements that allow the skin cleat to be loosened at least the prescribed amount without de-coupling the end sections can be used without departing from the scope of the disclosed embodiments. Providing a ski-cleat that has flexible end sections and a relatively flexible central section can be beneficial in that it allows the skin cleat to be compactly folded for storage when not in use.

At this juncture, it can be appreciated that, the end sections and central region can be made from one or more distinct segments of material that are joined together. Alternatively, multiple sections of the skin cleat can be defined by one or more continuous segments of material. For instance, as shown in FIG. 3A, the skin cleat included a continuous segment of strap defining the first and second end sections and the central section of the strap. By way of further example, as shown in FIG. 6, two segments of strap can be used to define the first end section 610 and the second end section 618 and joined to respective ends of a central portion of the skin cleat 620. It can also be appreciated that, although some exemplary arrangements of the skin cleat have been described as having a central portion that included an elongate central section of strap, elongate backing and studs, the central portion can alternatively be comprised of a single elongate structure (e.g., a single backing or strap) and studs coupled thereto, as shown in FIG. 6.

The material used to define the various elements of the skin cleat (e.g., straps, backing and the like) can include but is not limited to natural or synthetic textiles such as nylon, cotton or canvas, natural or synthetic leathers, polymers and the like. The material used to define the various portions of the skin cleat (e.g., rigid backing, studs etc.), can be made of a light sturdy plastic, such as acrylonitrile-butadiene-styrene copolymer, polyethylene, polyvinyl chloride, polycarbonate, polyproplene or styrene and the like and/or made from other strong, sturdy and water resistant materials, such as metals, composites, fiberglass and the like.

The central portion of the skin cleat preferably has a length that is smaller than the width of most ski-touring skis. In general, the width of the base of ski touring skis (i.e., where the boots are mounted) can range from 90 mm for smaller skis to 115 mm for powder skis. Accordingly, the central portion of a skin cleat that is intended for use with a wide range of touring skis can have a length that is between 80 and 90 mm long. Although, it can be appreciated that shorter and longer lengths are envisioned. Tests have shown that skin cleats having a central region falling within this range provide beneficial increase in purchase even when used on wider powder skis (e.g., skis having greater than a 120 mm width waist). Alternatively, in the exemplary arrangement, having studs that are selectively positionable at different locations along the length of the central section, the studs can be spaced apart, or added/removed to accommodate the width of the ski and thereby providing a skin cleat with generally universal applicability. Accordingly, while the central section of the strap and the backing might be longer than the width of the ski, the length of the studded portion can be made smaller than the width of the ski. Moreover, because the portion of the backing and strap that extends beyond the edges of the ski can be flexible, the assembly can nonetheless be tightened around the ski such that the skin cleat conforms to the cross-section of the ski even if the backing and central section of the strap is longer than the width of the ski.

Although certain regions of the skin cleat (e.g., end sections, central region) are described as distinct sections or regions and although certain features of the skin cleat are described as being part of a particular region, it can be appreciated that these features can be part of one or more regions.

Figure 7A:
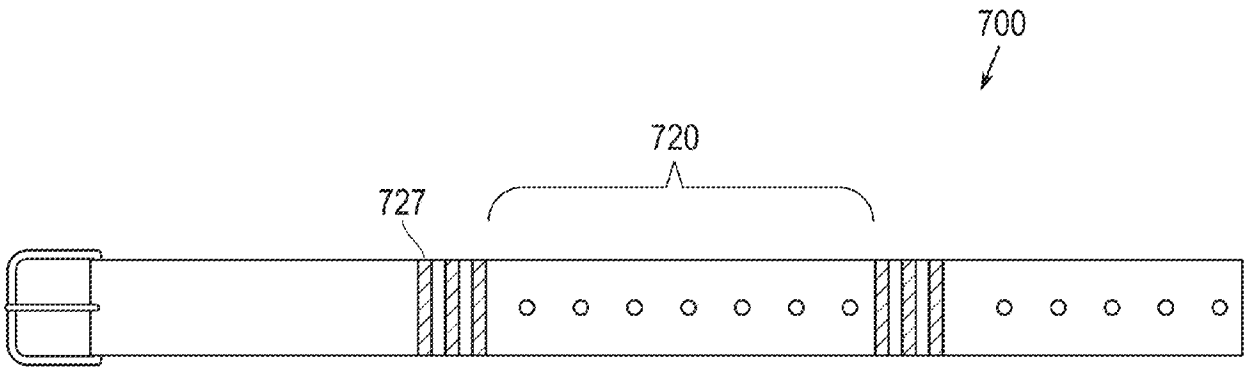
FIG. 7A is a diagram illustrating an exemplary configuration of a skin cleat according to an embodiment of the present invention.
Figure 7B:
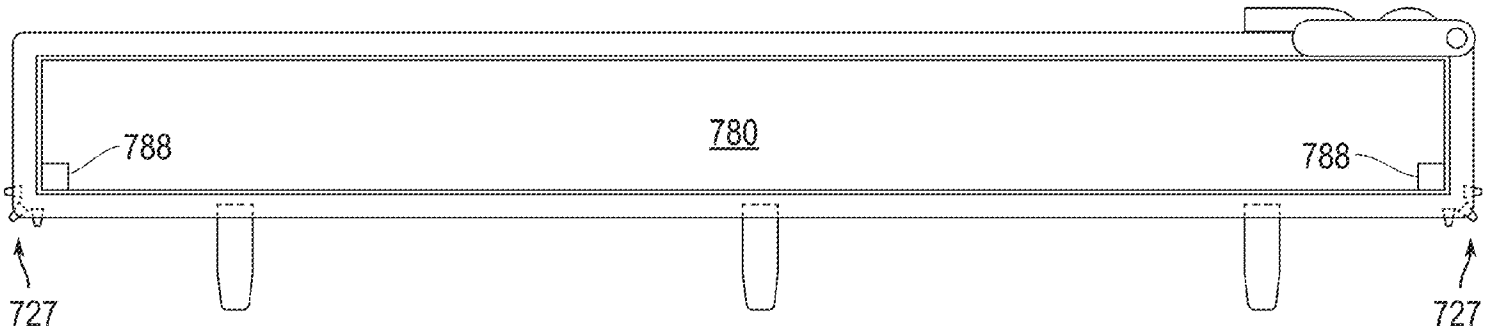
FIG. 7B is a diagram illustrating an exemplary configuration of a skin cleat according to an embodiment of the present invention.

Skis generally have metal edges that run the length of the underside of the ski and prevent the ski from sliding down the slope when oriented perpendicular to the fall line of the slope. Because the skin cleat would cover the ski's edge when disposed around the waist of the ski, the skin cleat can be configured to include one or more hard edge structures that compensate for the grip lost by covering the ski edge. FIG. 7B depicts an exemplary configuration of the skin cleat 700 comprising a strap 708 that includes one or more hard edges 727. The edges can be embedded in the strap or mounted to the strap such that they are exposed on the outer surface of the strap. The edges can also be positioned proximate to respective ends of the central portion 720 of the skin cleat and are preferably oriented perpendicular to the length of the skin cleat 700, in addition, multiple edges can be provided such that the strap can accommodate skis of varying width. FIG. 7B depicts the skin cleat 700 disposed around the waist of the ski and showing the edges 727 generally in registry with the edges 788 of the ski 780.

Figure 8:
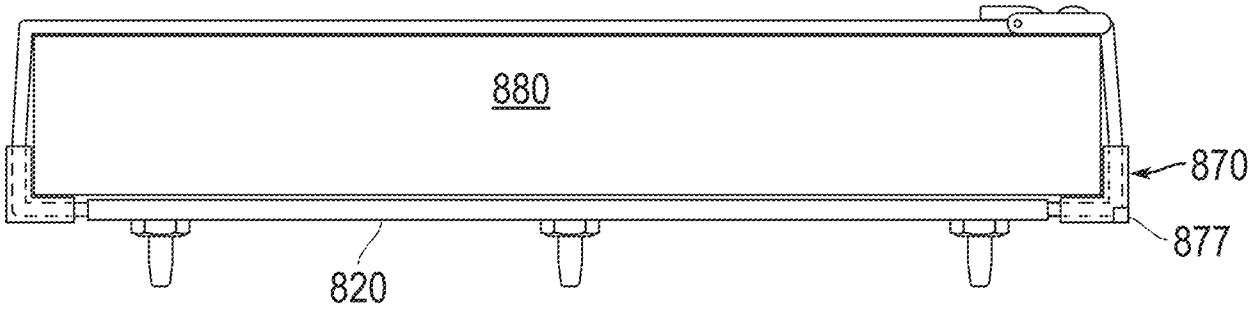
FIG. 8 is a diagram illustrating an exemplary configuration of a skin cleat according to an embodiment of the present invention.

In addition or alternatively, the edges can be provided as a separate structure that is coupled to the strap. For instance, as shown in FIG. 8, which is a front view of an exemplary skin cleat 800 disposed around the waist of the ski 880 (with the tip of the ski cut-away for clarity), the skin cleat 800 can include an edge structure 870 that comprises an L-shaped body that is preferably constructed from a resilient material. The body is preferably L-shaped such that a portion can be placed under the ski and a portion can be placed adjacent to the sidewall of the ski thereby holding the edge section in position when the skin cleat is tightened around the ski. Preferably the edge structure can be selectively positioned at various locations along the length of the end section so as to accommodate skis of varying width. For instance, the body can comprise a hollow structure that receives an end section therethrough such that the body can slide along the length of the end section. In addition or alternatively, the body can be attached to the strap using fasteners, joints or other suitable temporary or permanent joining means. The outside corner of the body preferably includes an exposed metal edge 877 that is either embedded within the structure or attached to the structure, so as to improve purchase similar to a ski edge.

Figure 9A:
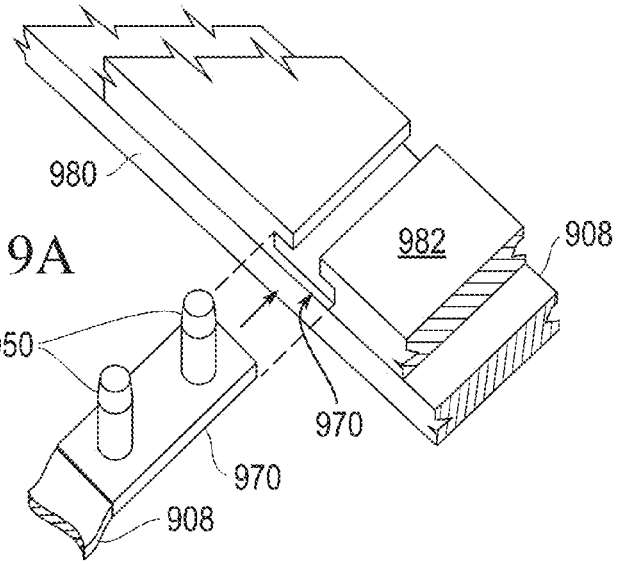
FIG. 9A is a diagram illustrating an exemplary configuration of an integrated skin and skin cleat according to an embodiment of the present invention.
Figure 9B:
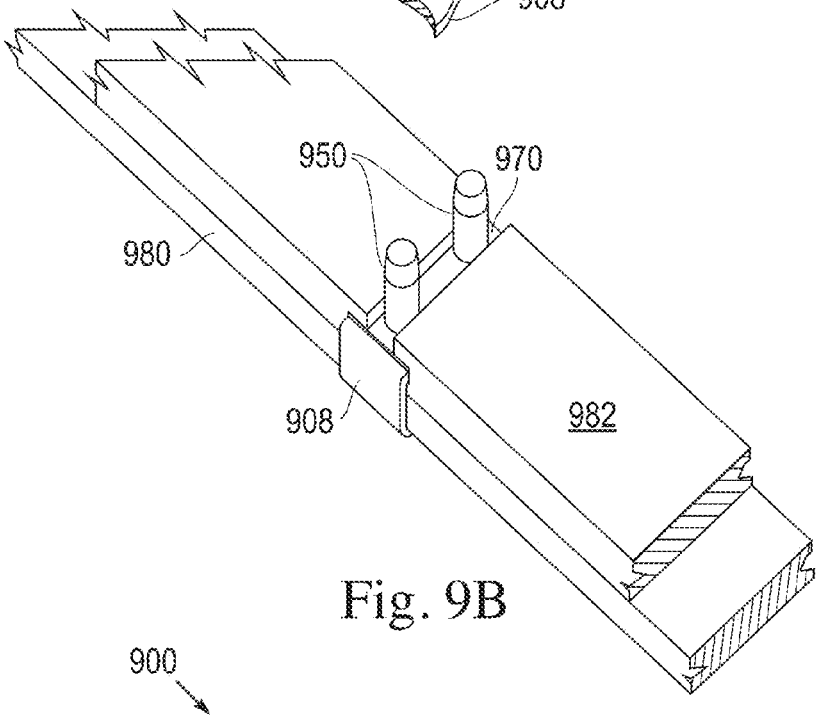
FIG. 9B is a diagram illustrating an exemplary configuration of an integrated skin and skin cleat according to an embodiment of the present invention.
Figure 9C:
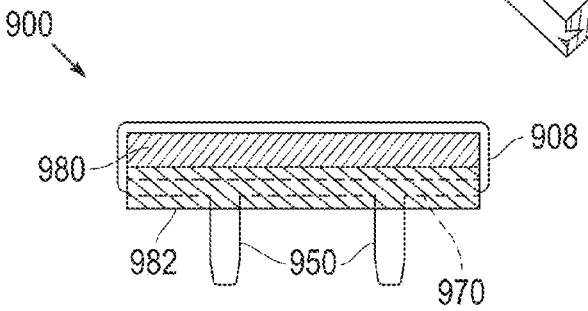
FIG. 9C is a diagram illustrating an exemplary configuration of an integrated skin and skin cleat according to an embodiment of the present invention.

In another exemplary arrangement, one or more of the previously described elements of the skin cleat can be integrated into a climbing skin so as to provide a combined skin and skin cleat. FIG. 9A depicts a perspective, bottom-view of an exemplary configuration of an integrated skin and skin cleat assembly 900. FIG. 9B depicts a perspective bottom-view of the integrated skin and skin cleat assembly 900 assembled. FIG. 9C depicts a front view and cut-away view of the skin and skin cleat assembly 900. As shown, the assembly includes a mount 970 embedded within the base of the skin 982. The mount is configured to engage the cleats. For instance, the mount 970 can be a c-shaped channel (e.g., as discussed in relation to FIGS. 5A-5B) or other similar track-like structure that is configured to receive one or more studs 950 therein and retain the studs in position. For example, the studs 950 can be mounted to a backing 920 that has a complementary shape to the mount 970 such that the backing can be inserted into the mount. Accordingly, the studs can be held in place due to the complementary shape of the backing and the mount. In addition or alternatively, a strap 908 can be attached to ends of the backing/stud assembly and secured around the ski 980 so as to keep the backing/studs engaged to the mount when in use, for example, as shown in FIG. 9B. Moreover, as described above, the skin cleat can also include a coupling (not shown) for selectively loosening the strap a prescribed amount such that the studs can be rotated from a position in which they are engaging the mount to a position in which the studs are not engaging the mount.

Because climbing skins are generally thin and have a uniform thickness so as to promote glide in the direction of ski travel, and the portion of the skin cleat that is contained within the skin when in use (e.g., the mount, backing, the proximal end of the studs, the strap and the like) can have a greater thickness than a traditional climbing skin, the thickness of the skin 982 can be graduated such that the bottom of the ski while mounted to the ski provides a generally flat surface, with the exception of the studs protruding from the bottom of the skin.

In accordance with these and other aspect of the disclosure, additional configurations and variations of the disclosed skin cleat device are further described herein.

As noted, the skin cleat is a strap-like device that includes two end sections and a studded central section 1120 therebetween. The central section is intended to be placed underneath the base (i.e., the underside) of the ski (and a skin, if a skin is being used) such that the studs extend down into the snow. Two end sections can be attached together by a coupling to form a continuous structure around the waist of the ski (e.g., orthogonal to the direction of ski travel).

Figure 10A:
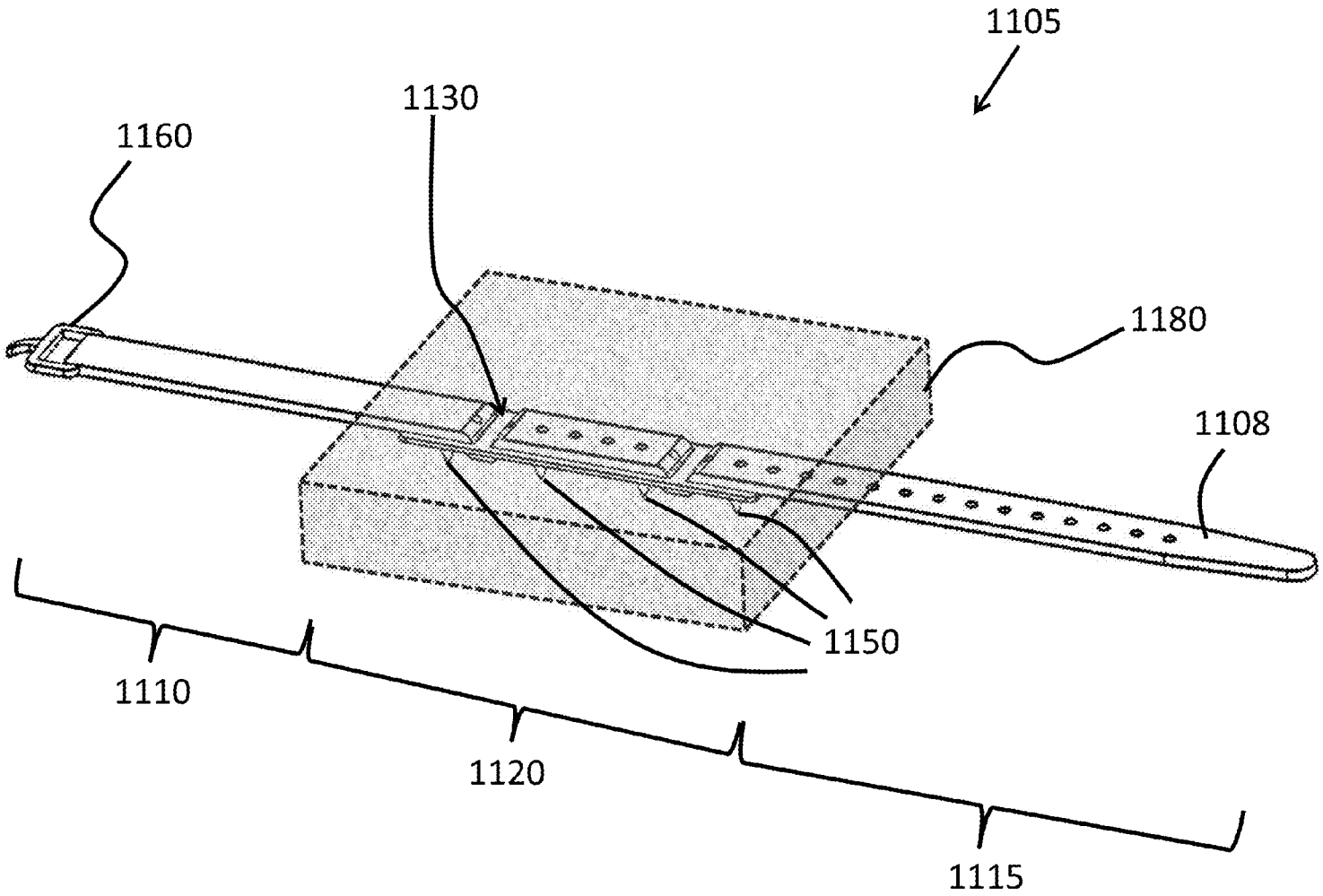
FIG. 10A is a schematic diagram illustrating a top-perspective view of a skin cleat in accordance with one or more embodiments of the present invention.
Figure 10B:
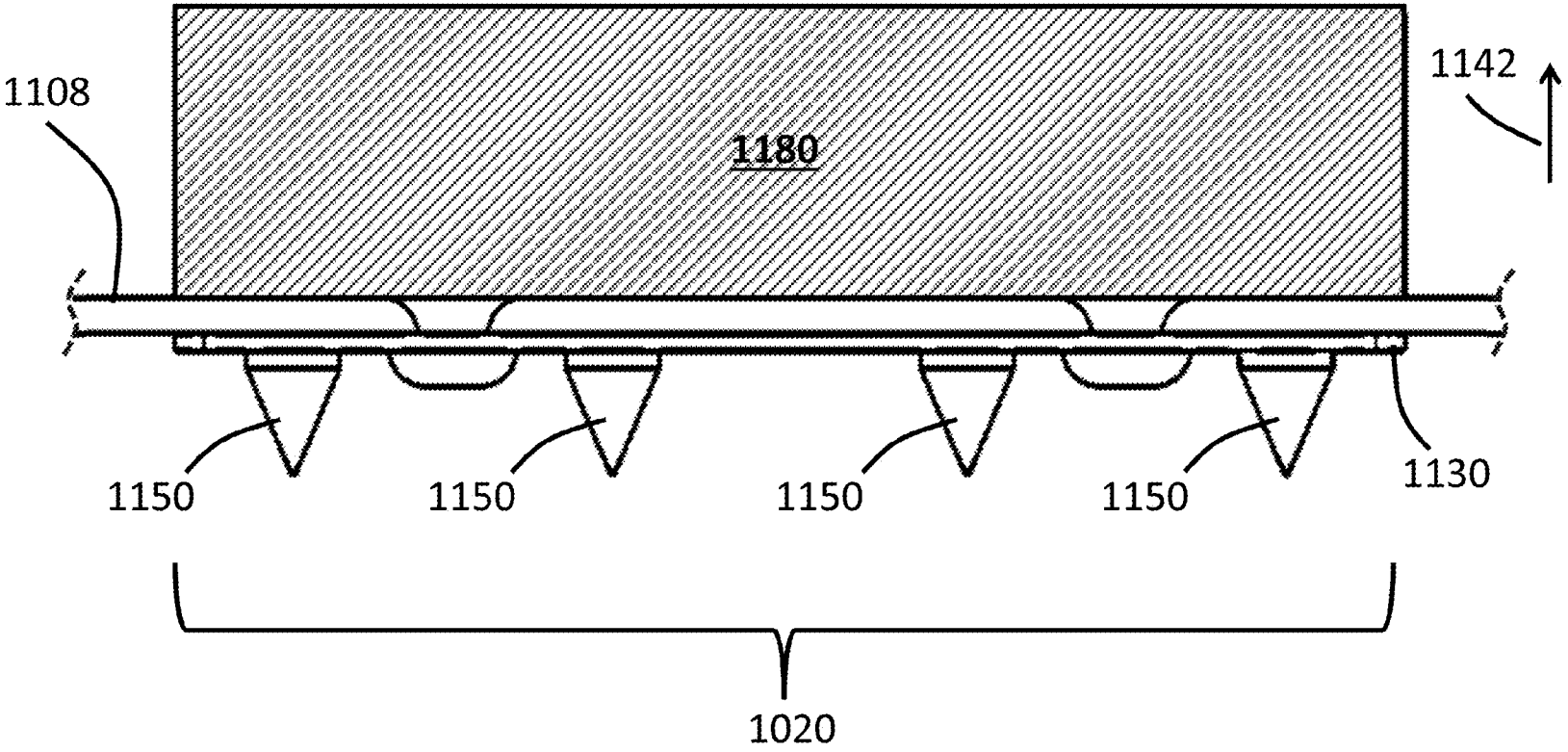
FIG. 10B is a schematic diagram illustrating a close-up front view of the skin cleat of FIG. 10A in accordance with one or more embodiments of the present invention.
Figure 10C:
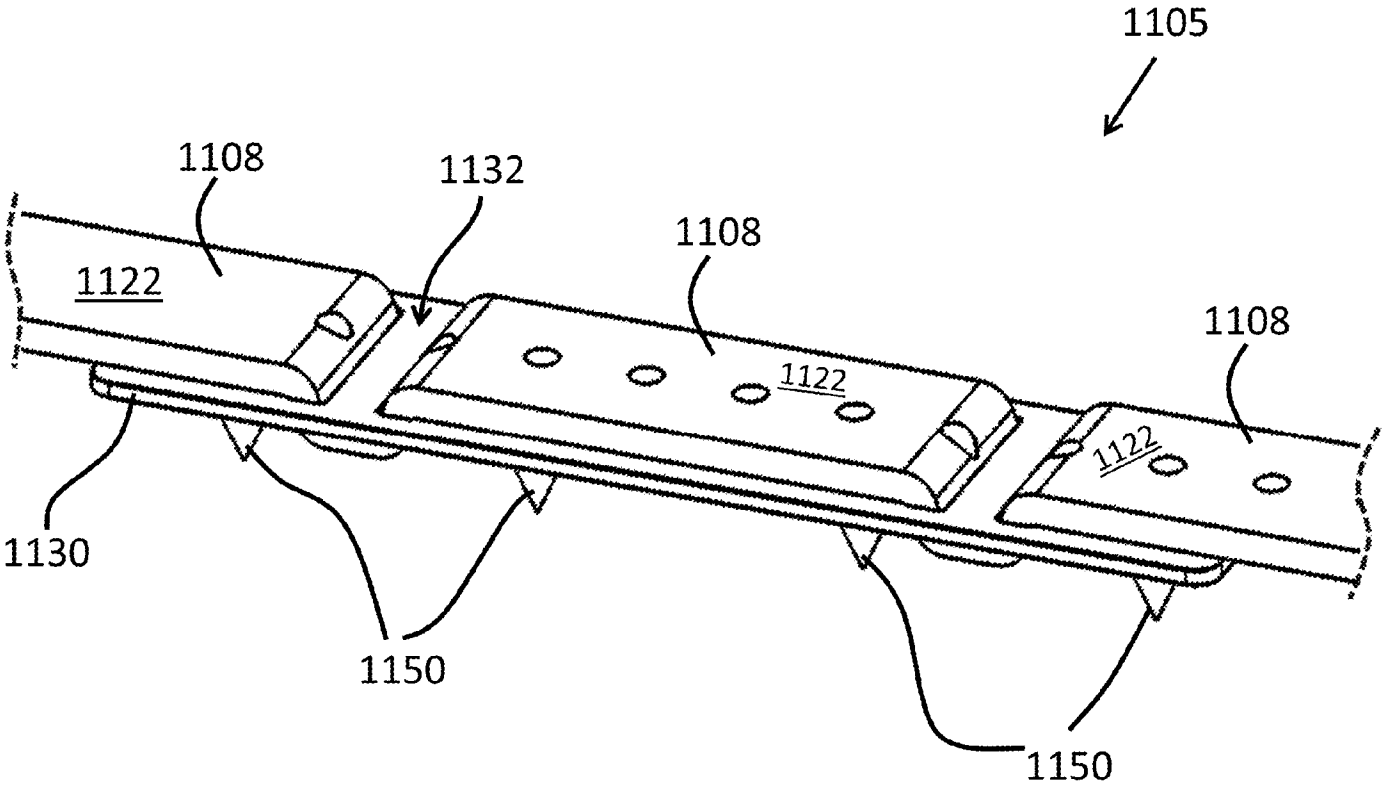
FIG. 10C is a schematic diagram illustrating a top-perspective view of the skin cleat of FIG. 10A in accordance with one or more embodiments of the present invention.
Figure 10D:
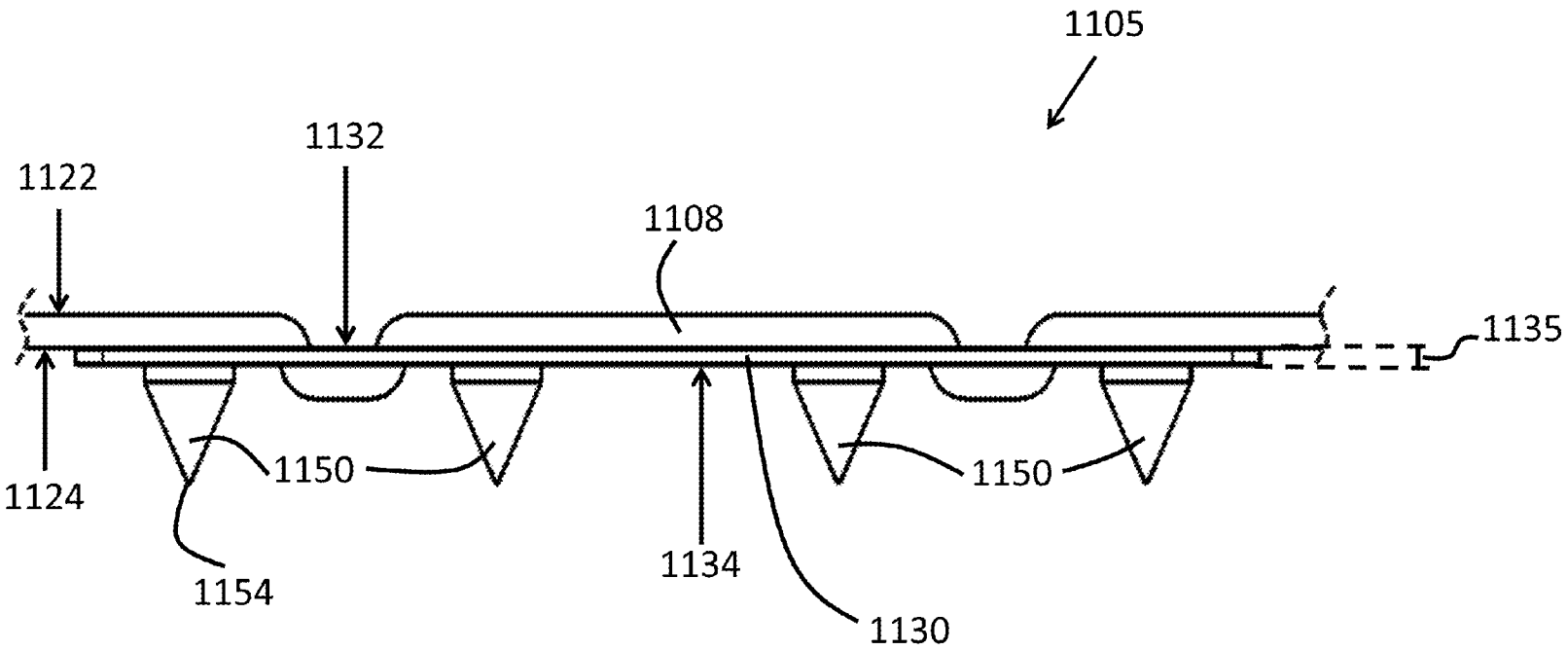
FIG. 10D is a schematic diagram illustrating a front view of the skin cleat of FIG. 10A in accordance with one or more embodiments of the present invention.
Figure 10E:
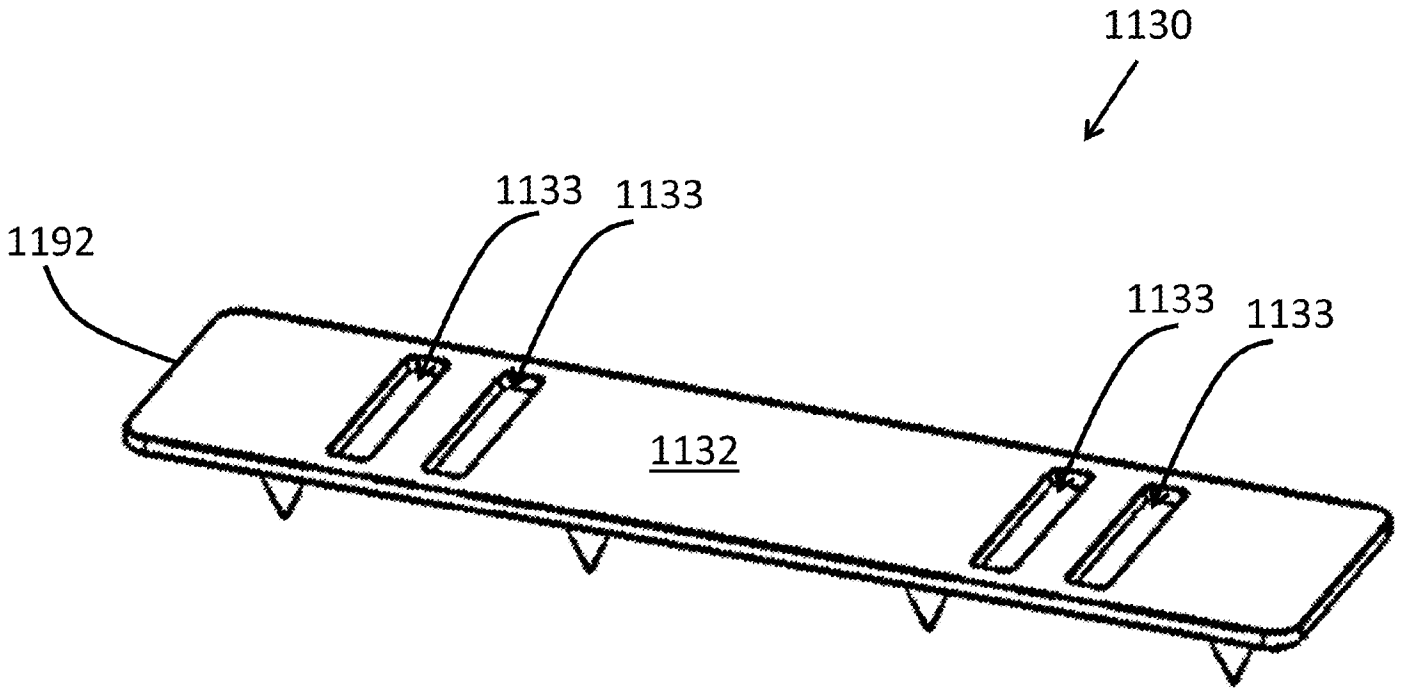
FIG. 10E is a schematic diagram illustrating a top-perspective view of a backing of the skin cleat of FIG. 10A in accordance with one or more embodiments of the present invention.
Figure 10F:
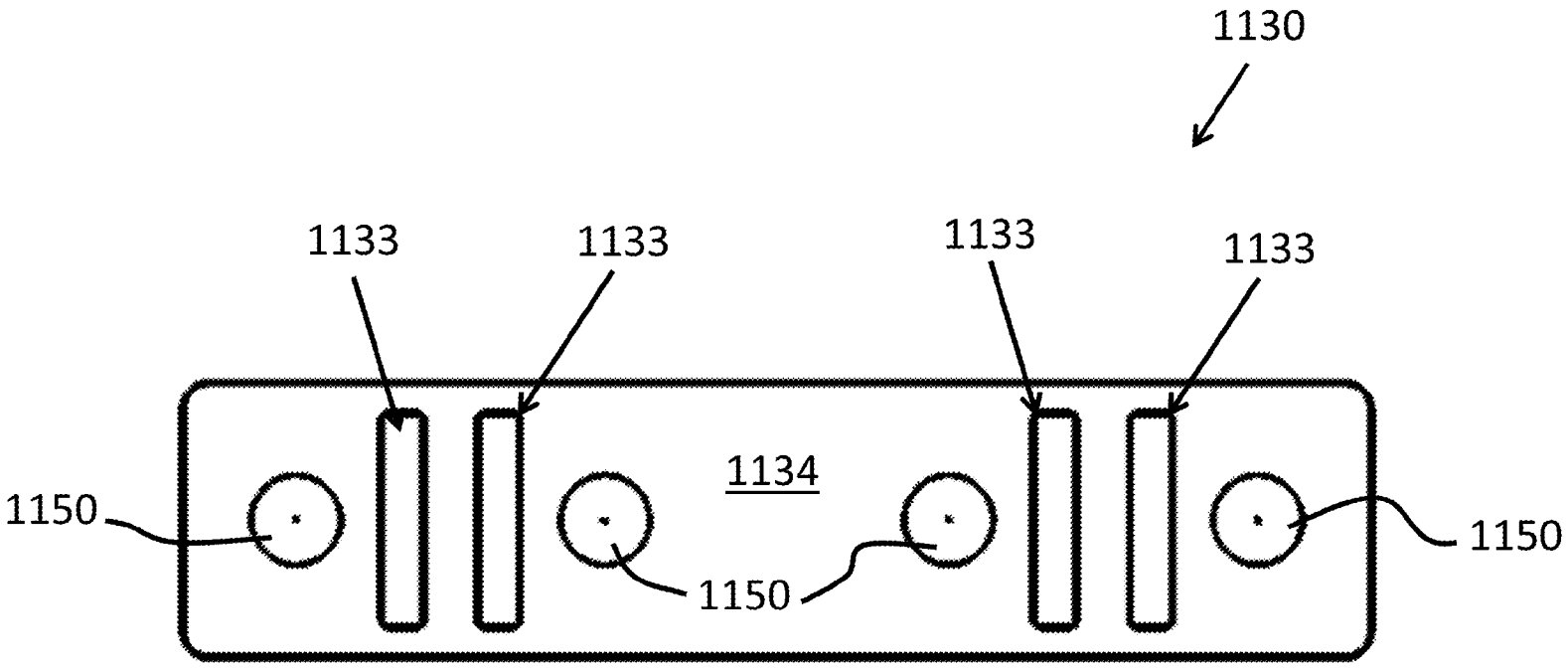
FIG. 10F is a schematic diagram illustrating a bottom plan view of the backing of FIG. 10E in accordance with one or more embodiments of the present invention.
Figure 10G:
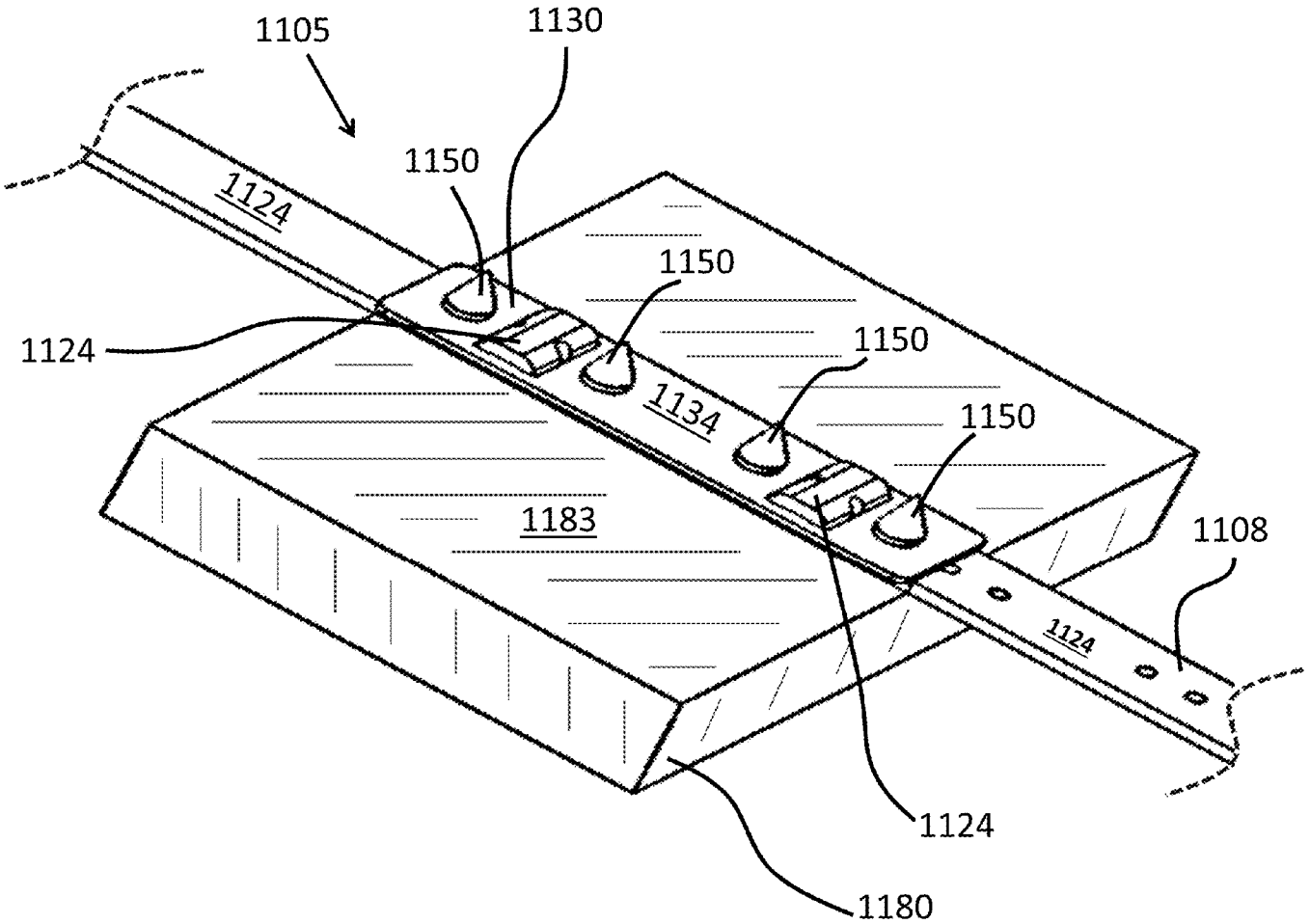
FIG. 10G is a schematic diagram illustrating a bottom-perspective view of the skin cleat of FIG. 10A in accordance with one or more embodiments of the present invention.

FIGS. 10A-10G depict an exemplary skin cleat assembly 1105 according to one or more of the disclosed embodiments. FIG. 10A is a top-perspective view of the skin cleat 1105 in an unattached configuration and disposed beneath a transparent cut-away schematic section of a ski 1180. FIG. 10B depicts a close-up front view of the skin cleat 1105 in an unattached state and disposed beneath a ski 1180 (the front section of the ski and the ends of the skin cleat have been cut-away to more clearly show the central portion of the skin cleat). FIG. 10C depicts a top-perspective view of the skin cleat 1105 in an unattached configuration. FIG. 10D depicts a front view of the skin cleat 1105 in an unattached configuration. FIG. 10E depicts a top-perspective view of a backing of the skin cleat 1105. FIG. 10F depicts a bottom plan view of a backing of the skin cleat 1105. FIG. 10G depicts a bottom-perspective view of the skin cleat 1105 in an unattached state and positioned against the underside of a ski 1180 (the front/rear section of the ski and the ends of the skin cleat have been cut-away to more clearly show the central portion of the skin cleat in the view from underneath the ski).

As shown in FIG. 10A, the skin cleat assembly 1105 includes a first end section 1110 and a second end section 1115 and a central section 1120 there between. Also shown is an illustrative coupling 1160 which, along with complementary holes formed in the end sections defined by the strap, can be used for selectively attaching the first and second end sections resulting in the formation of a continuous structure about the waist of a ski (e.g., ski 1180). The first and second end sections and at least a portion of the central section are defined by an elongate, flexible strap 1108. For instance, as shown in FIG. 10A, the strap 1108 is a continuous structure that defines the first end section 1110, the second end section 1115 and also extends through the central section 1130 of the skin cleat 1105. Preferably, the strap 1108 is composed of any number of conventional materials that are suitable for use in straps including but not limited to plastic, rubber, leather, synthetic materials (moldable/polymerizable materials), webbing and the like. In the exemplary embodiment, the strap is defined by a continuous segments of material. In alternative arrangements the strap can be comprised of a plurality of segments of one or more materials.

As shown in FIG. 10A, the central section 1120 also includes a backing 1130 for protecting the underside of the ski when in use and studs 1150 depending downward and away from the central section of the skin cleat (i.e., extending in a direction opposite the vertical direction 1142 shown in FIG. 10B). Accordingly, the central section 1130 of the skin cleat 1105 is comprised of the central section of the strap 1108 and the backing 1130.

As shown in FIGS. 10C and 10D, the backing 1130 has a first side 1134 and has an opposite second side 1132 (also referred to as first surface 1134 and second surface 1132).

The second side 1134 is the side that is positioned closer to the underside of the ski 1183 relative to the opposite first side 1134 (e.g., the second side is facing the underside of the ski when in use). Accordingly, the opposite first side 1132 is the side that is closer to the ground (i.e., faces the ground) during use. Similarly, as shown in FIG. 10D, the strap includes a top side 1122 (i.e., the side that is facing or generally closer to the ski relative to the opposite bottom side when in use) and an opposite bottom side 1133 (i.e., the side facing or generally closer to the ground relative to the top side of the strap when in use).

The backing also has a thickness 1135 and is composed of one or more materials that absorb and/or distribute the forces transferred to the backing by the studs 1150. The backing can also have a rigidity which is sufficient to distribute the forces from the studs across the second side 1132 of the backing.

Also shown in FIGS. 10A-10G are studs 1150 extending from the central section 1120 of the skin cleat 1105. As noted, the studs can be joined to the backing or the strap, or a combination of the foregoing. In the exemplary skin cleat 1105, a proximal end (or "head") of the studs 1150 are joined to the backing 1130 and, more specifically, are integral with the backing. The integral forming of stud and backing can be performed according to any conventional manufacturing techniques. In addition or alternatively, the studs can be fixedly or removeably joined to the backing using the aforementioned exemplary mounting techniques (e.g., a threaded cylindrical hole within the backing that receives and matingly engages complementary shaped threads on the stud).

Each stud of skin cleat 1105 extends away from the first surface 1134 of the backing toward a distal, free end 1154 of the stud. In other words, the studs depend from the first surface 1134 generally in a direction away from the backing and strap provided at the central section of skin cleat 1105.

As noted, in accordance with one or more of the disclosed embodiments, the skin cleats including a backing and strap can be joined in a fixed or movable configuration. FIGS. 10A-10G illustrate the skin cleat 1105 having the backing 1130 and the strap 1108 coupled in a moveable configuration. FIGS. 10E and 10F depict a top-perspective view and bottom-plan view, respectively, of the backing 1130 configured to be coupled to the strap 1108 (not shown) using one or more mounts 1133. As shown, each mount 1133 comprises a hollow structure that can be integrally defined in the backing and the strap 1108 can be passed therethrough such that the backing can slide linearly along the length of the strap.

More specifically, the backing 1130 includes four mounts 1133 each comprising a hollow opening that the strap 1108 can be passed through such that the backing can be positionable along the length of the strap 1108 by sliding the backing linearly along the strap. The openings extend through the first and second surfaces 1132 and 1134 of the backing and are provided for receiving the strap therethrough such that the strap passes along the length of the backing and the backing is positionable along the strap within and through the openings.

FIGS. 10C and 10D further illustrate the strap 1108 passed through each of the openings of the mounts. As shown, the strap can be weaved through the openings. Accordingly, the strap passes along at least a portion of the first side 1134 of the backing and the second side 1132 of the backing. More specifically, as shown in FIG. 10D, the strap extends from a first end of the backing linearly along the second side 1132 of the backing until a first opening in a series of mounts/openings 1133. The strap passes through the first opening and continues extending linearly along the opposing first side 1134 until the next opening, at which point it passes through the opening back to the first side. As can be appreciated, the strap can be weaved through any remaining openings in a similar fashion. It can be further appreciated that the position of the backing 1130 along the length of the strap 1108 can be adjusted by incrementally feeding the strap through the series of openings in a desired direction.

The exemplary embodiment in which the strap 1108 is passed through openings provided in the backing 1130 and extends along the length of the backing can serve to maintain the relative position of the strap and backing during use, while also enabling the backing to be repositioned along the length of the strap, if necessary. More specifically, the strap, backing and mounts 1133 comprising the openings, can be configured to achieve an amount of friction between the backing and the central section of strap that is sufficient to maintain the backing in position along the strap (e.g., while the skin cleat is tightened about the waist of the ski or even while unattached), while still allowing the backing to be manually re-positioned along strap by the user (e.g., when the skin cleat is in an unattached state).

For instance, in some implementations, the strap 1108 can be comprised of a rubbery and compressible material having a particular stiffness/flexibility and coefficient of friction that promotes friction between the strap and the various portions of the backing that the strap contacts (e.g., the surfaces of the backing and edges/sides of the mounts 1133 that the strap passes through). By way of further example, the size and shape of the mounts/openings 1133 relative to the width and thickness of the strap (which can also be pre-defined) can also be defined to provide a suitable amount of friction between the strap and the edges of the openings. By way of further example, the distance between two mounts/openings 1133 (e.g., the distance between the two openings positioned closest to the end 1192 of backing shown in FIG. 10E) can also be defined to achieve a suitable resistance to linear movement of the backing, while still allowing for manual repositioning of the backing by the user, if necessary.

By comparison, according to the exemplary strap and mount configuration illustrated in FIG. 4D, the strap 108 can be positioned relative to the backing 130 by sliding the strap through the openings defined by mounts 133. The friction between the strap, backing and mount structure 133 can resist movement of the backing relative to the strap, particularly when the assembly is cinched around the waist of a ski. Further, it can be appreciated that the sliding of the strap through the mount openings 133 faces relatively lower resistance, particularly when unattached, as compared to the skin cleat 1105 of FIGS. 10A-10G in which the strap is weaved through the series of openings. While the embodiment of FIG. 4D can provide a user benefit of easier repositioning of the backing and strap, the embodiment of FIGS. 10A-10G provides a user benefit of greater resistance to movement of the backing along the strap, while still facilitating manual adjustment to effect repositioning.

It should be understood that more or fewer mounts can be provided in the backing 1130 without departing from the scope of the disclosed embodiments. For instance, as described previously in connection with FIG. 4C-E, the strap can be passed through only two mounts defining hollow openings, through four mounts as shown in FIG. 10G, or an additional, preferably even number of mounts. An even number of mounts defining openings for receiving the strap therethrough can be preferable such that the strap emerges from the backing on the same side that it entered the backing (e.g., sides 1132 or 1134).

As shown in FIGS. 10A-10B, the skin cleat 1105 is configured such that the section of strap 1108 that passes along portions of the second side of the backing 1132 can be placed against the underside of the ski during use. Accordingly, the strap can be configured to cushion the underside of the ski or skin and, in some implementations, can be comprised of a compressible material. While the backing is shown as being spaced apart from the underside of the ski, the invention is not so limited. It should be appreciated that in addition or alternatively, the strap and backing can be configured such that one or more sections of the backing that directly face the underside of the ski (i.e., the second side 1132) can be in contact with the underside of the ski or skin. For instance, whether the backing is in direct contact with the underside of the ski can be a function of the thickness of the strap, the number of mounts 1133, the location of the mounts, and the path that the strap follows through the openings and along the first and second surfaces 1134 and 1132, as well as the dimensions of the ski (or skin) relative to the backing 1130 and the material characteristics of same (e.g., compressibility of the skin).

Thus, while there have been shown, described, and pointed out fundamental novel features of the invention as applied to several embodiments, it will be understood that various omissions, substitutions, and changes in the form and details of the devices illustrated, and in their operation, may be made by those skilled in the art without departing from the spirit and scope of the invention. Substitutions of elements from one described embodiment to another are also fully intended and contemplated. It is also to be understood that the drawings are not necessarily drawn to scale, but that they are merely conceptual in nature. The invention is defined solely with regard to the claims appended hereto, and equivalents of the recitations therein.

What is claimed:

1. A skin cleat for use with a ski, ski-boot and binding assembly and to improve purchase while ascending a slope, comprising:

an elongate strap having first and second end sections and having a central section there-between, wherein the central section has a first thickness and a bottom side and a top side;

a coupling for selectively attaching the first and second end sections resulting in the formation of a continuous structure;

a backing having a thickness, a first side abutting the top side of the central section, an opposite second side for placement against an underside of the ski and for protecting the underside of the ski, wherein the backing comprises a first and a second opening for receiving the strap therethrough such that the strap passes along a length of the backing and the backing is positionable along the central section of the strap; and a stud having a proximal end and a distal end and a head disposed at the proximal end, wherein the stud is mounted to the backing and extends away from the bottom side of the central section.

2. The skin cleat of claim 1, wherein the distal end of the one or more studs is positioned to engage the slope, and wherein the second side of the backing is disposed between the proximal end of the stud and the underside of the ski thereby protecting the underside of the ski from the proximal end of the stud.

3. The skin cleat of claim 1, wherein the one or more studs are one or more of: fixedly attached to the backing, removeably attached to the backing, and integral with the backing.

4. The skin cleat of claim 1, further comprising a plurality of studs.

5. The skin cleat of claim 1, wherein the coupling is configured to attach the first and second end sections at any of a plurality of positions so as to provide a continuous structure of adjustable size.

6. The skin cleat of claim 5, wherein the coupling is configured to attach the first and second end sections to form the continuous structure around the ski without detaching one or more of the ski-boot and binding assembly from the ski.

7. The skin cleat of claim 1, wherein the first and second end sections are composed of an elastic material.

8. The skin cleat of claim 1, wherein the backing is configured to absorb and distribute forces applied to the distal end of the stud, and wherein the backing is comprised of one or more of a compressible material and a rigid material.

9. The skin cleat of claim 1, wherein the backing further comprises a third and a fourth opening for receiving the strap therethrough such that the strap passes along a length of the backing and the backing is positionable along the central section of the strap within and through the first, second, third and fourth openings, and wherein the first, second, third and fourth openings extend through the first and second sides of the backing.

10. The skin cleat of claim 1, wherein the central section of strap passes along one or more of: the first side of the backing and the second side of the backing.

11. A skin cleat for use with a ski, ski-boot and binding assembly and to improve purchase while ascending a slope, comprising:

an elongate strap having first and second end sections and having a central section there-between;

a coupling associated with one or more of the first and second end sections and configured to attach the first and second end sections resulting in the formation of a continuous structure; and a backing having a first surface and an opposite second surface for protecting the underside of the ski, wherein the backing comprises a first and a second opening for receiving the strap therethrough such that the strap passes along a length of the backing and the backing is positionable along the central section of the strap;

one or more studs having a proximal end and a distal end and a body extending therebetween, wherein the one or more studs are mounted to the backing and depend downwardly away from the first side of the backing in a direction away from the backing and the strap.

12. The skin cleat of claim 11, wherein the distal end of the one or more studs is positioned to engage the slope, and wherein the second side of the backing is disposed between the proximal end of the one or more studs and the underside of the ski thereby protecting the underside of the ski from the proximal end of the one or more studs.

13. The skin cleat of claim 11, wherein the first and the second openings extend through the first surface and opposite second surface of the backing.

14. The skin cleat of claim 13, wherein the backing further comprises a third and a fourth opening extending through the first and opposite second surface and for receiving the strap therethrough such that the strap passes along a length of the backing and the backing is positionable along the central section of the strap within and through the first, second, third and fourth openings.

15. The skin cleat of claim 11, wherein the central section of the strap passes along the length of the backing along one or more portions of the first surface of the backing and one or more portions of the second surface of the backing.

16. The skin cleat of claim 11, wherein the central section of the strap comprises an elastic material and wherein the backing is configured such that friction between the backing and the central section of strap passed through the openings maintains the backing in position along the strap when the strap is coupled around the ski.

17. A skin cleat for use with a ski, ski-boot and binding assembly and to improve purchase while ascending a slope, comprising:

an elongate strap having first and second end sections and having a central section there-between;

a coupling associated with one or more of the first and second end sections and configured to attach the first and second end sections resulting in the formation of a continuous structure; and a backing having a first surface and an opposite second surface, wherein the backing comprises a first and a second opening through the first and opposite second surface for receiving the strap therethrough such that the strap passes along a length of the backing and the backing is positionable along the central section of the strap; and a plurality of studs mounted to the backing, wherein each of the studs has a proximal end and a distal free end, and wherein the studs depend downwardly away from the first side of the backing.

18. The skin cleat of claim 17, wherein the backing further comprises a third and a fourth opening through the first and opposite second surface for receiving the strap therethrough such that the strap passes along a length of the backing and the backing is positionable along the central section of the strap within and through the first, second, third and fourth openings.

19. The skin cleat of claim 18, wherein the strap passes along the length of the backing along one or more portions of the first surface of the backing and one or more portions of the second surface.

20. The skin cleat of claim 19, wherein the central section of the strap comprises an elastic material and wherein the backing is configured such that friction between the backing and the central section of strap passed through the first, second, third and fourth openings maintains the backing in position along the strap when the strap is coupled around the ski.

* * * * *